US005385784A

United States Patent [19]

Sasaki et al.

[11] Patent Number: 5,385,784

[45] Date of Patent: Jan. 31, 1995

[54] DEEPLY DYED POLYESTER FABRIC

[75] Inventors: Yoshiyuki Sasaki, Takatsuki; Shigenobu Kobayashi, Toyonaka; Katsuyuki Kasaoka, Ibaraki; Tomio Matsubara, Ikoma; Kaoru Asada, Kashihara, all of Japan

[73] Assignee: Teijin Limited, Osaka, Japan

[21] Appl. No.: 193,059

[22] PCT Filed: Sep. 16, 1992

[86] PCT No.: PCT/JP92/01196

§ 371 Date: Mar. 7, 1994

§ 102(e) Date: Mar. 7, 1994

[87] PCT Pub. No.: WO94/06957

PCT Pub. Date: Mar. 31, 1994

[51] Int. Cl.[6] ..... D02G 3/00

[52] U.S. Cl. ..... 428/369; 428/364; 428/366; 428/370; 428/373; 428/393; 428/395; 428/401

[58] Field of Search ..... 428/364, 366, 369, 370, 428/373, 401, 393, 395

[56] References Cited

FOREIGN PATENT DOCUMENTS

| | | |
|---|---|---|
| 57-25439 | 2/1982 | Japan . |
| 57-25440 | 2/1982 | Japan . |
| 59228041 | 12/1982 | Japan . |
| 1246430 | 10/1989 | Japan . |
| 2210076 | 8/1990 | Japan . |

*Primary Examiner*—Samuel A. Acquah
*Attorney, Agent, or Firm*—Armstrong, Westerman, Hattori, McLeland & Naughton

[57] ABSTRACT

A deeply dyed polyester fabric exhibiting a lightness index L* value of 25 to 60. Fibers at least in the surface layer portion of either or both of the warps and wefts exhibit a light transmittance to an extent such that the difference ΔX (%) between the light transmittance X⊥ (%) of polarized light vibrating perpendicular to the fiber axis at a wavelength of the maximum absorption and the light transmittance X II (%) of polarized light vibrating parallel to the fiber axis at the same wavelength is not larger than 10%.

9 Claims, 28 Drawing Sheets

DEEPLY DYED POLYESTER FABRIC

TECHNICAL FIELD

This invention relates to a dyed polyester fabric having a good color depth, which is comparable to or superior to those of fabrics of natural fibers.

By the term "good color depth" used herein, we mean that the fabric is dyed not only deeply but also with an enhanced brilliancy, i.e., deeply dyed without turbidity and light-brownish coloration.

BACKGROUND ART

Recently, the characteristics of polyester fibers have been remarkably improved. Especially, feeling, touch and drape of polyester fabrics have been improved to a level comparable to that of natural fibers (for example, Japanese Examined Patent Publication No. 61-36099). Nevertheless, appearance, particularly the color depth, of the dyed polyester fabrics is not attractive as compared with those of fabrics of natural fibers such as silk and wool. It is therefore usual that consumers' interest is not excited at the first sight, even though the feeling and other characteristics are improved.

Proposals of improving the dyeability and other dyeing properties have heretofore been made, which include, for example, the copolymerization of a specific comonomer to effect relaxation of the fibrous structure (Japanese Examined Patent Publication No. 63-39686) and the formation of micropores in the surface portion of the fiber to effect diffused reflection (Japanese Examined Patent Publication No. 62-28229). However, dyed polyester fabrics made by these proposals are still not satisfactory in the color depth which term is used in a broad sense in the present specification, i.e., in the color depth with brilliancy, although they are dyed deeply.

DISCLOSURE OF THE INVENTION

An object of the present invention is to provide a dyed polyester fabric exhibiting a good color depth which is comparable or superior to those of natural fiber fabrics, as well as a good feeling, touch and drape.

In accordance with the present invention, there is provided a dyed polyester fabric composed of warps and wefts, which are dyed with a lightness index L* value of 25 to 65; fibers at least in the surface layer portion of either or both of the weft and the warp exhibiting a light transmittance to an extent such that the difference (ΔX in %) between the light transmittance (X⊥ in %) of polarized light vibrating perpendicular to the fiber axis at a wavelength of the maximum absorption and the light transmittance (XΠ in %) of polarized light vibrating parallel to the fiber axis at the same wavelength is not larger than 10%.

BEST MODE FOR CARRYING OUT THE INVENTION

Figure 1:
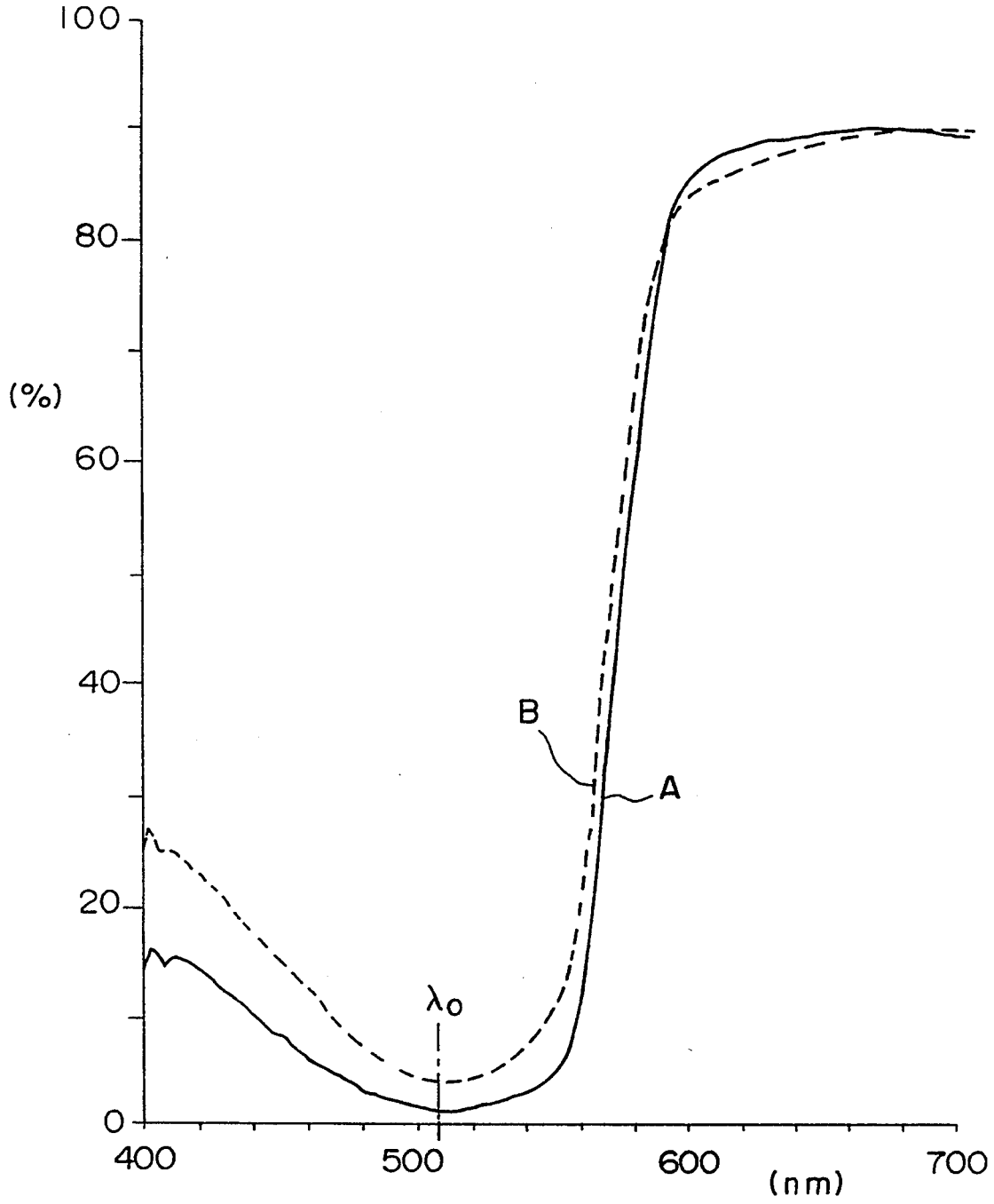
FIG. 1 shows graphs of light transmittances of fibers in the surface layer portion of the yarn constituting an example of the dyed polyester fabric of the present invention.

FIG. 1 is graphs of light transmittances of polarized light through fibers in the surface layer portion of the warp and/or weft constituting the dyed polyester fabric of the invention, wherein the ordinate and the abscissa denote light transmittance (%) and wavelength (nm), respectively.

In FIG. 1, curve A (solid line) shows a light transmittance of polarized light vibrating parallel to the fiber axis, and curve B (broken line) shows a light transmittance of polarized light vibrating perpendicular to the fiber axis.

In FIG. 1, the graphs are characterized in that there is no substantial difference between the light transmittance (XΠ %) (curve A) of polarized light vibrating parallel to the fiber axis at a wavelength ($\lambda_0$ nm) of the maximum absorption and the light transmittance (X⊥ %) (curve B) of polarized light vibrating perpendicular to the fiber axis at the same wavelength ($\lambda_0$ nm), and further that, in the other wavelength regions, there is no great difference between the light transmittance (XΠ) (curve A) of polarized light vibrating parallel to the fiber axis and the light transmittance (X⊥) of polarized light vibrating perpendicular to the fiber axis. Only when the difference (ΔX) between the two light transmittances XΠ and X⊥ of polarized light at a wavelength of the maximum absorption is not more than 10%, i.e., $$\Delta X = X\perp - X\Pi \leqq 10\%,$$

the polyester fabric exhibits a satisfactorily enhanced color depth without light-brownish coloration.

Figure 2:
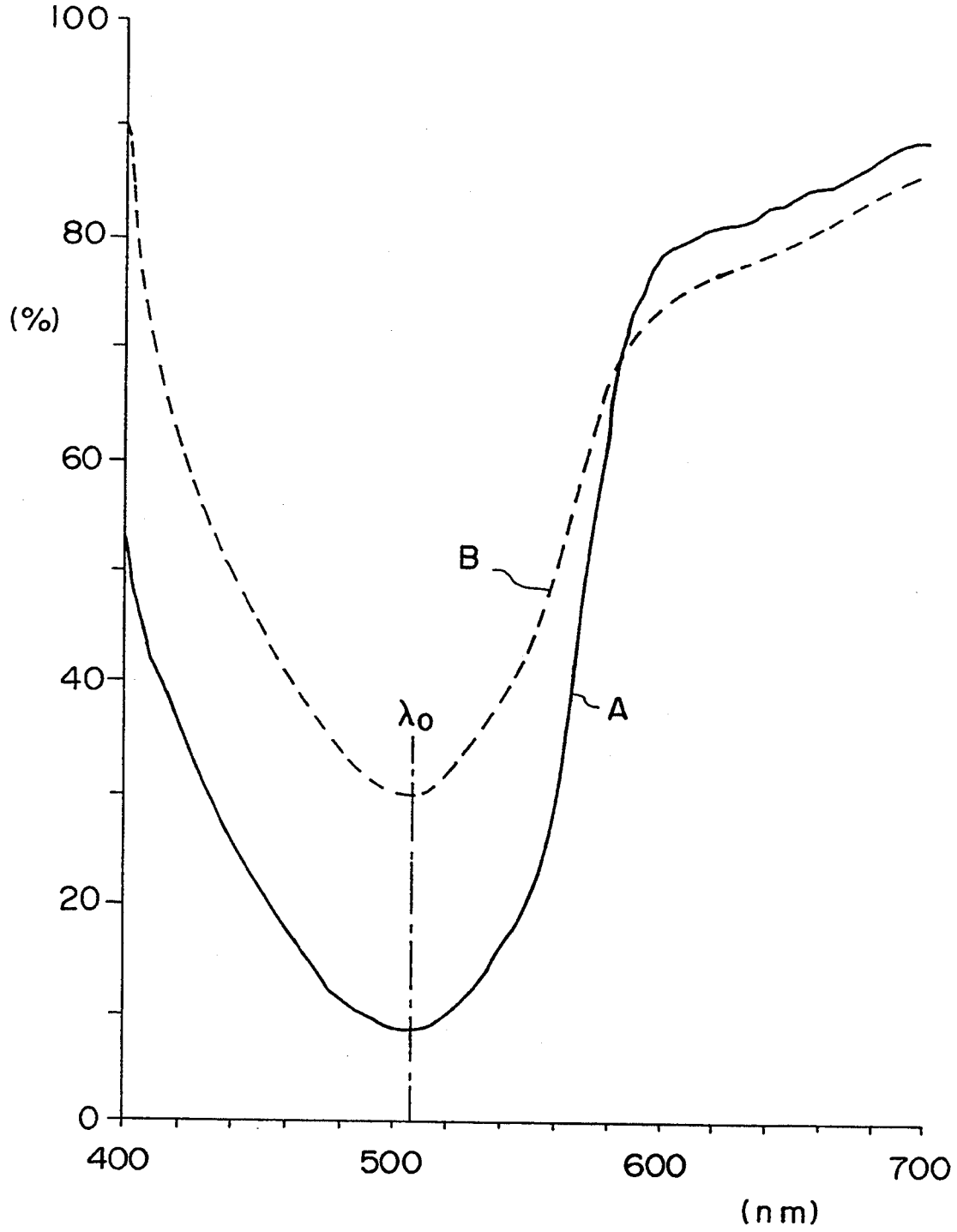
FIG. 2 shows graphs of light transmittances of fibers of a conventional dyed polyester fabric having an improved feeling.

FIG. 2 shows graphs of light transmittances XΠ and X⊥ of polarized light vibrating parallel and perpendicular to the fiber axis, respectively, through fibers in a conventional dyed polyester fabric having an improved feeling. In contrast to the graphs shown in FIG. 1, the difference ΔX in the two light transmittances X⊥ and XΠ is larger than 20% at a wavelength ($\lambda_0$) of the maximum absorption and is also large in most of the other wavelength region. When the difference ΔX between the two light transmittances X⊥ and XΠ are large, the absorption of light is insufficient and white light is found in the light of the developed color, with the result that the developed color is not satisfactory.

Before going into detailed explanation of the dyed polyester fabric of the invention, our fundamental view on the principle of color development by a dye will be described to facilitate the understanding of the invention.

When a polyester fiber is dyed with a dye, the color development occurs due to light absorption by the dye penetrated into the fiber. The inventors have conducted researches as to how the light penetrated in the fiber is capable of absorbing light sufficiently to develop a deep color with brilliancy.

Figure 3:
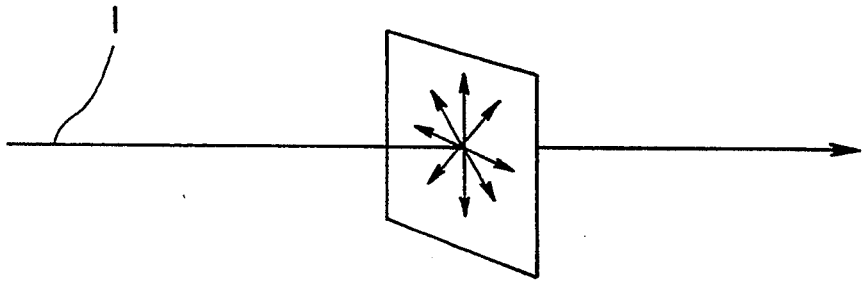
FIG. 3 is a diagram illustrating the vibrating plane of natural light.
Figure 4:
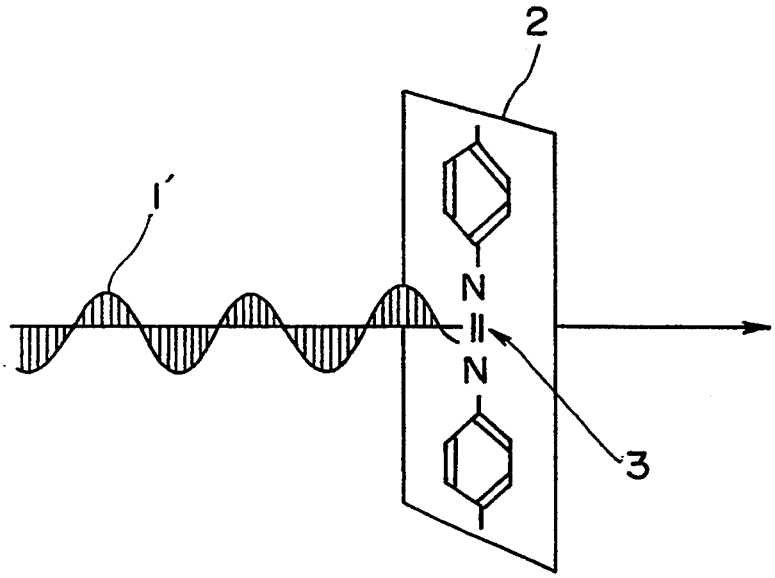
FIG. 4 is a diagram illustrating a principle of color development.
Figure 5:
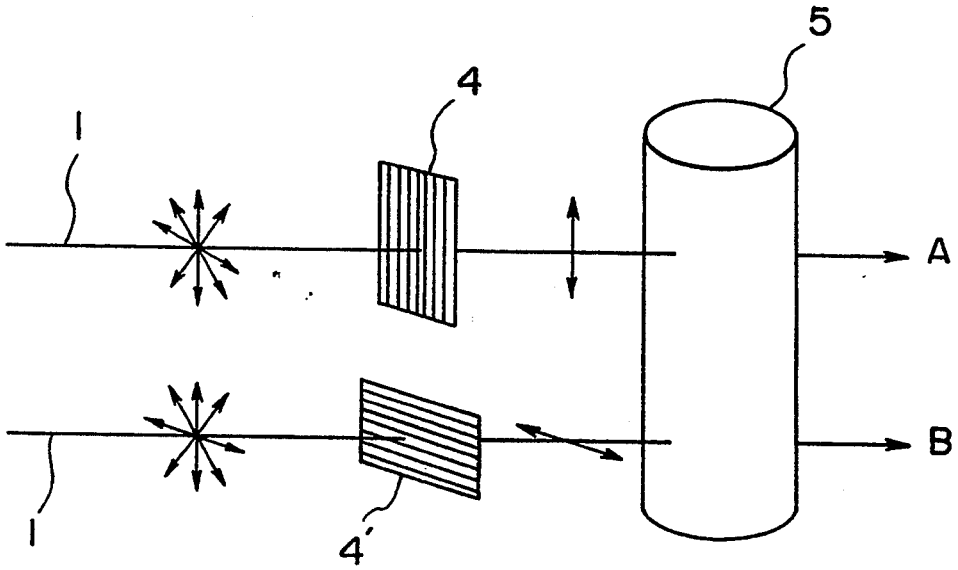
FIG. 5 is a diagram illustrating a light transmittance (A) of polarized light having a vibrating plane parallel to the fiber axis, and a light transmittance (B) of polarized light having a vibrating plane perpendicular to the fiber axis.

Light is an electromagnetic wave which is a kind of transverse waves, and, as diagrammatically shown in FIG. 3, natural light (1) has vibrating planes distributed in all directions. It is to be noted that, as diagrammatically shown in FIG. 4, color development by a dye occurs in the case where a vibrating plane (1') of light is in agreement with the bonding direction of the conjugated double bond (3) in the dye molecule (2), light having a wavelength of the vibrating plane is absorbed. It is considered that the best step for obtaining the intended color depth lies in absorption of the entire vibrating planes of natural light which are distributed in all directions. That is,.if part of the vibrating planes remains unabsorbed, the color developed by the absorbed light contains white light and the developed color contains light-brownish color to some extent and thus the color depth is poor.

The inventors have determined the proportion of the quantity of the vibrating planes absorbed and that of the vibrating planes unabsorbed in fibers of a conventional dyed polyester fabric having an improved feeling. This determination is carried out by a procedure wherein the vibrating planes of all directions are divided into a plurality of pairs each comprising two vibrating planes perpendicular to each other by using polarizing plates (4, 4'), and the quantities of the divided perpendicular vibrating planes are measured on the fiber (5) of the conventional dyed polyester fabric.

As the results, it has been found that, as shown in an example of FIG. 2, the light transmittance (B) of polarized light vibrating perpendicular to the fiber axis is considerably larger than that (A) of polarized light vibrating parallel to the fiber axis, i.e., the absorption of the vibration of electromagnetic waves of the former is smaller than that of the latter. Obviously, there is a great difference in absorption between the two kinds of polarized light.

Figure 6:
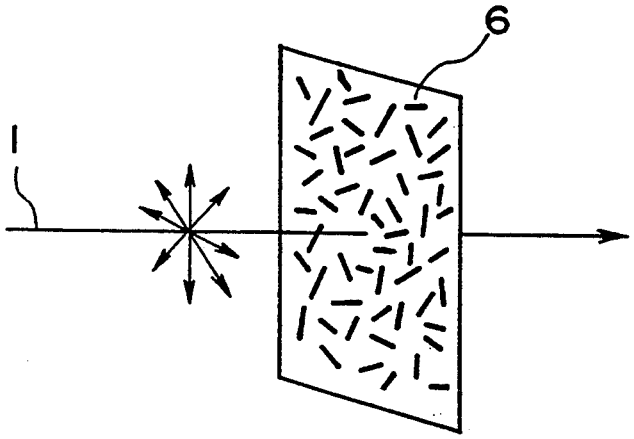
FIG. 6 is a diagram illustrating the state wherein dye molecules are distributed in a random manner within a polyester fiber and thus the vibrating planes of natural light which are distributed in all directions are absorbed.
Figure 7:
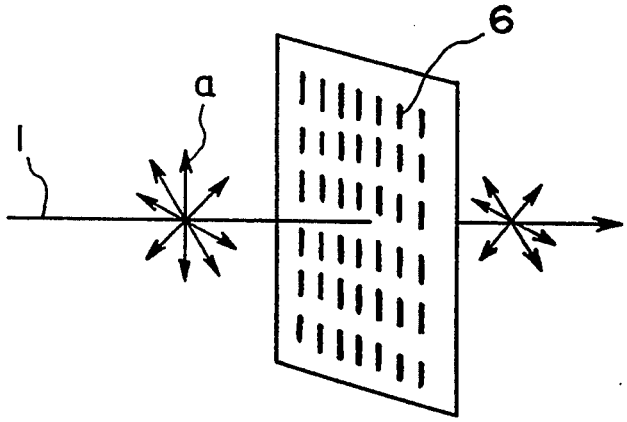
FIG. 7 is a diagram illustrating the state where dye molecules are oriented in one direction within a polyester fiber and thus only one vibrating plane of natural light which is oriented in one direction is absorbed.

If dye molecules (6) are distributed in a random state such that the molecules are oriented in all directions, as shown in FIG. 6, the conjugated double bonds of the dye molecules are also oriented in all directions, and therefore, the vibrating planes of natural light oriented in all directions are entirely absorbed and thus a brilliant and deep color is developed. In contrast, if the dye molecules (6) are distributed in a state such that the molecules are oriented in one direction, as shown in FIG. 7, and there is a great difference between the light transmittance (XII) of polarized light vibrating parallel to the fiber axis and that (X⊥) of polarized light vibrating perpendicular to the fiber axis, then only one vibration of light ((a) in FIG. 7) is absorbed and the other vibrations of light pass through the fiber, and thus, the resulting developed color has a reduced color depth and looks somewhat darkish and light-brownish.

The inventors have further examined the relationship of the above-mentioned difference in the absorption of vibrating planes of electromagnetic waves with the visual color depth in various kinds of dyed polyester fabrics. The results obtained are shown in Table 1.

TABLE 1

| Run No. | ΔX (%) | Y | Dyed Yarns |
|---|---|---|---|
| 1 | 30 | 1 | Conventional silky blended yarn |
| 2 | 27 | 2 | Yarn having multiplicity of ultra-micro-pores in the surface portions |
| 3 | 33 | 3 | Yarn modified with a metal sulfonate group |
| 4 | 17 | 5 | Blended yarn containing a lowly-oriented fibers |
| 5 | 14 | 5 | Readily dyeable yarn spun at a ultra-high spinning speed |
| 6 | 5 | 8 | Trial run yarn (1) |
| 7 | 3 | 10 | Trial run yarn (2) |

Note: Details of the dyed yarns listed in Table 1 are given in the working examples, below.

In Table 1, ΔX (%) denotes the difference between the light transmittance (X⊥) of polarized light vibrating perpendicular to the fiber axis at a wavelength of the maximum absorption and the light transmittance (XII) of polarized light vibrating parallel to the fiber axis, $$\Delta X(\%) = X\perp - X\text{II}.$$

Y (class) denotes color depth expressed by 10 rating visual organoleptic test and provided that the color depth of silk is class 7. Numerical values "10" and "1" means the largest color depth and the smallest color depth, respectively.

As seen from the above results, the magnitude of the difference (ΔX) between the two light transmittances (X⊥) and (XII) of polarized light vibrating perpendicular and parallel, respectively, to the fiber axis has a clear and close relationship with the visual color depth (Y). The smaller the ΔX value, the better the Y value.

In fact, the dyed polyester fabric of the present invention is characterized as exhibiting an extremely small ΔX value, i.e., a surprisingly enhanced visual color depth Y, as compared with the conventional yarns, even though there is no difference in the amount of dye used between the yarn of the fabric of the present invention and the conventional yarns. When the difference (ΔX) between the light transmittance (X⊥ in %) of polarized light vibrating perpendicular to the fiber axis and the light transmittance (XII in %) of polarized light vibrating parallel to the fiber axis is not larger than 10% as defined in the present invention, a dyed polyester fabric having a color depth of a level exceeding the color depth of silk (Y=class 7 as shown in Table 1) is obtained. The dyed polyester fabric having such a high color depth have heretofore not obtained from the conventional polyester fibers.

The dyed polyester fabric of the present invention characterized as exhibiting the above-mentioned enhanced color depth is made by a process wherein a polyester yarn having a specific structure is used as the warp and/or the weft and a specific dye is used for dyeing the yarns or the woven fabric.

Ordinary polyester fibers have a dense structure and exhibit a high crystallinity, and therefore, when dyed, the dye penetrates into non-crystalline regions of the fibers. However, even in the non-crystalline regions, the polyester molecules are oriented although to a minor extent, and therefore, the dye molecules are oriented to some extent in the direction parallel to the fiber axis as illustrated in FIG. 7, with the result that vibrating planes of electromagnetic waves parallel to the fiber axis are absorbed, but vibrating planes thereof perpendicular to the fiber axis are absorbed only to a limited extent. Thus, a great difference arises between the transmittance of the planes vibrating parallel to the fiber axis and the transmittance of the planes vibrating perpendicular to the fiber axis, and undesirable light-brownish coloration is caused.

To prevent the above-mentioned orientation of dye molecules and obtain the state wherein the dye molecules are oriented randomly in all directions as illustrated in FIG. 6, polyester fibers wherein the polyester molecules are not oriented at all or oriented only to a negligible extent must be used. Typical examples of such polyester fibers are (i) undrawn fibers which have been made by carrying out the fiber spinning at a spinning speed of 1,000 to 2,000 m/min and have not been subjected to a drawing step, and (ii) fibers which have been made by carrying out the fiber spinning at a spinning speed higher than 2,000 m/min but not higher than 5,000 m/min and heat-treating the spun fibers at a temperature of at least 220° C. under relaxed conditions to thereby completely relax the polymer molecules in the non-crystalline regions. When such polyester fibers are made, at least one of the following steps can be additionally employed: a step of melt-spinning the polymer at a temperature higher than 300° C. at orifices of a spinneret, a step of spinning the polymer at a high spinning draft ratio of at least 1,000, and a step of employing a copolyester having copolymerized therein a modifying comonomer. It is to be noted that the intended color depth with brilliancy, which has a color depth value Y rated as being higher than class 7, cannot be obtained merely by a readily dyeable fiber which has been made at a ultra-high spinning speed; a fiber having micropores in the surface portion thereof which has been made by incorporating ultra-fine particles in a polymer and dissolving the ultra-fine particles out from the polymer fiber after fiber-spinning; a fiber which has been rendered readily dyeable by treating with a metal sulfonate; and a fiber which has been heat-treated under relaxed conditions such that the non-crystalline regions are relaxed. Preferably, the dyed polyester fabric of the invention is made from polyester fibers wherein the degree of molecular orientation in the non-crystalline regions is negligible and similar to that found in undrawn fibers which are usually of no practical use.

However, the above-mentioned polyester fibers possessing an extremely reduced degree of molecular orientation in the non-crystalline regions are very easily elongated by an external force and have a very poor mechanical strength. Therefore, these polyester fibers are used preferably in combination with reinforcing highly oriented polyester fibers to provide a yarn having a practically acceptable mechanical strength.

Figure 8A:
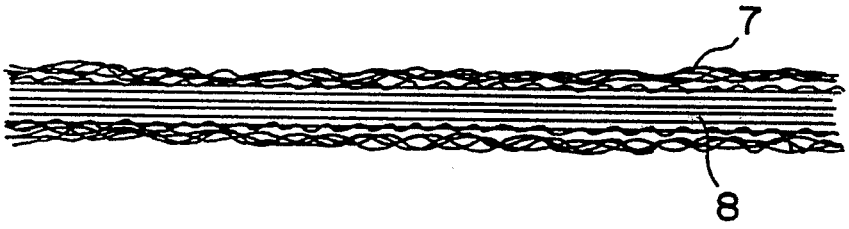
Figure 8B:
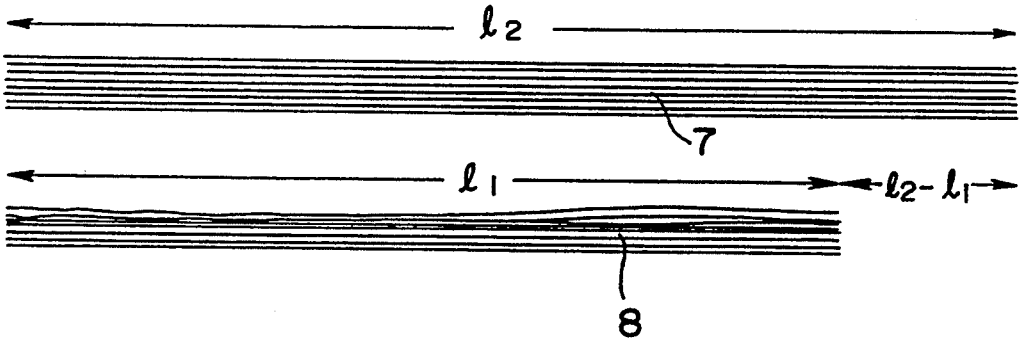

The highly oriented polyester fibers exhibit a poor color depth, when dyed. Therefore, to provide a yarn exhibiting a good color depth and having a practically acceptable mechanical strength, a composite yarn having a double-layer structure is advantageously used which is, as illustrated in FIG. 8A, composed of a core of reinforcing highly oriented fibers (8) and a surface layer of fibers having a poor mechanical strength but exhibiting an enhanced color depth (7). The mechanical strength of the yarn is predominantly dependent upon the reinforcing core fibers (8) and the deeply colored appearance of a dyed yarn is solely dependent upon the sheath fibers (7) exhibiting a good color depth. This composite yarn is advantageously made from sheath fibers having a length of $l_2$ and reinforcing core fibers (FIG. 8B) having a length of $l_1$ wherein $l_2$ and $l_1$ satisfy the requirement: $\Delta l \times 100 \geqq 5\%$ wherein $\Delta l = (l_2 - l_1)/l_1$. To bear the external force applied to the yarn by the reinforcing core fibers (8), the fibers (8) should preferably have an elongation which is not larger than 50% and not larger than two-thirds and, more preferably, not larger than one half of the elongation of the sheath fibers (7) exhibiting a good color depth. For the same purpose, the reinforcing core fibers (8) should preferably have a tenacity, expressed per denier, which is at least 1.5 times and, more preferably, at least 2 times that of the sheath fibers.

It is also important to select dyes for dyeing the yarn or the woven fabric. As hereinbefore explained, in the deeply dyed polyester fabric of the invention, dye molecules are distributed in a random manner such that the molecules are oriented in all directions as illustrated in FIG. 6, whereby all vibrating planes of natural light can be absorbed, and thus, undesirable light-brownish coloration is minimized and a brilliant and deep color is developed. However, light absorption in one direction is relatively weak as compared with the light absorption in which all of the dye molecules are oriented as illustrated in FIG. 7. Further, the color depth greatly varies depending upon the particular dye used. More specifically, dyes having conjugated double bonds as many as possible in the molecule exhibit an enhanced light absorption and give a very deep color. That is, the intended color depth is obtained by the combined use of the fiber having an extremely reduced molecular orientation in the non-crystalline regions and the dye having many conjugated double bonds in the molecule. In general, the higher the molecular weight of a dye, the more the conjugated double bonds in the dye molecule. Therefore, a dye having a large molecular weight is preferably used in the present invention. It should be noted, however, that a dye having a high molecular weight is readily oriented by the orientation of the polymer molecule of a fiber, when the dye is absorbed by the fiber. Therefore, the degree of molecular orientation in the non-crystalline regions of the polymer should be minimized. Dyes having a molecular weight of at least 380 are preferable and, as dyes having a such a high molecular weight, there can be mentioned, for example, those which appear hereinafter in Table 2.

In the present invention, the difference ($\Delta X$) between the light transmittance of polarized light vibrating perpendicular to the fiber axis and the light transmittance of polarized light vibrating parallel to the fiber axis is an important measure for the fabrication of the deeply dyed polyester fabric. However, if both of the two light transmittances are almost zero, i.e., the color is too dark, or if both of the two transmittances are close to 100%, i.e., the color is too light, then the dyed polyester fabric having the intended color depth cannot be obtained. Therefore, the lightness index L* value must be in a limited range which is from 25 to 65.

The dyeing procedure for the polyester fabric will be described in the following.

The gray fabric is subjected to scouring and is then dyed. The dyeing machine used is not particularly limited, and those which are widely used for dyeing conventional polyester fabrics can be used. However, a dyeing machine of the type wherein a dyeing bath is circulated is preferable for dyeing the fabric woven from the yarns composed of reinforcing core fibers and deeply dyeable sheath fibers. Usually, the gray fabric is dipped in a dyeing bath at a bath ratio of 1:5 to 1:50 o.w.f., the temperature is elevated in 15 to 60 minutes to a predetermined dyeing temperature which is at least 120° C., and the dyeing bath is maintained at that temperature for 15 to 90 minutes. Preferably, the temperature elevation is effected gradually over a period of 45 to 60 minutes, and the dyeing is effected at a temperature of at least 130° C. for a period of at least 45 minutes. The amount of dye used is determined depending upon the intended degree of color depth.

The above-mentioned deeply dyeable polyester yarns used for the deeply dyed fabric are costly in the production and troublesome to handle. Therefore, the deeply dyeable yarns can be woven in combination with other yarns into a mixed woven fabric from an economical viewpoint. In the fabrication of the mixed woven fabric, it is preferable that the deeply dyeable yarns are of a larger crimp, i.e., are curved with a larger radius of curvature at the crossing points of the warps and the wefts than that of the other yarns so that the deeply dyeable yarns are exposed to a great extent to enhance the development of a deep color with brilliancy. Such a mixed woven fabric is advantageously made by weaving warps composed of the deeply dyeable polyester yarns and wefts composed of the other yarns in a manner that the warp is overfed at a relaxing or finish setting step so as to possess larger crimps. For example, the warp curvature and the weft curvature are at least 20% and not larger than 7%, respectively. Further, the deeply dyeable polyester fiber preferably occupy at least 50%, more preferably at least 55%, based on the weight of the fabric.

The fabric of the invention can be a crepe fabric which is woven from a hard twist yarn and has crinkled surfaces. The following problems should be noted which are encountered when a crepe fabric is manufactured as the deeply dyed fabric of the invention. That is, first, a hard twist yarn has a rough surface and exhibits an enhanced diffused reflection which leads to reduction of color depth, and secondly, a yarn composed of fibers having little or no orientation in the non-crystalline regions does not exhibit a good crepe effect. These problems can be solved by using as the weft a hard twist yarn having, for example, at least 1,000 twists per meter, which is made of a yarn capable of being easily made into a hard twist yarn, and using as the warp a deeply dyeable polyester yarn in a manner such that weave crimps of the warp are larger than those of the weft and thus the warp is much more exposed on the surface of the woven fabric.

Cellulosic fibers such as acetate rayon and viscose rayon have a much better color depth than conventional polyester fibers, although inferior to natural silk. However, these cellulosic fibers have defects such that fabrics thereof are readily wrinkled and shrunk when washed. Therefore, these fibers are used usually in combination with polyester fibers for weaving into fabrics. But, conventional polyester fibers and cellulosic fibers have a color depth greatly different from each other, and, a mixed fabric woven therefrom has a poor color depth because the color depth of the conventional polyester fibers offsets that of the cellulosic fibers.

In contrast, when cellulosic fibers and deeply dyeable polyester fibers are woven into a fabric, the resulting mixed fabric is characterized as exhibiting an excellent and matched color depth and possessing good feeling due to the cellulosic fibers and good functions due to the polyester fibers. The procedure by which the mixed fabric is woven from the cellulosic fibers and the polyester fibers is not particularly limited. For example, the cellulosic fibers and the polyester fibers are spun into a blended yarn, or the cellulosic yarn and the polyester yarn are interlaced, twined or twisted each other into a yarn, and the resulting yarn is woven into a fabric. Alternatively, the cellulosic yarn and the polyester yarn are woven together into a mixed fabric by using one of the two kinds of yarns as the warp and the other as the weft. It is preferable that the deeply dyeable polyester yarn as the warp and the cellulosic yarn as the weft are woven into a mixed fabric in a manner such that weave crimps of the warp are larger than those of the weft. Thus, a visually and sensuously excellent mixed fabric can be obtained which has a good color depth due to the warp and good drape and feeling due to the weft.

The color depth of the deeply dyed fabric of the invention is most conspicuous when the polyester yarn used is in the form of a flat filament yarn composed of straight filaments, but a somewhat similar effect is obtained even when the polyester yarn used is composed of crimped or looped fibers or a hard twist yarn so as to impart to the fabric better feeling, heat insulation and stretchability. Further, even when the polyester yarn used is a spun yarn made of staple fibers, a somewhat similar color depth can be obtained although diffused reflection occurs to some extent due to the fluff and disordered fibers of the spun yarn.

In the case of warp or weft knitted fabrics, the deeply dyed mixed fabric can be made, for example, by knitting the deeply dyeable polyester yarn for the warp or weft knitted fabrics, or knitting the deeply dyeable polyester yarn as the weft or warp in the course of preparation of warp or weft knitted fabrics, respectively, of the other yarns.

The polyester fiber used in the invention is not particularly limited, and may have either a round section or a polygonal section. The polyester fiber having a polygonal section exhibits not only a good color depth but also a good luster. Ordinary polyester fibers having a porous structure and extremely fine polyester fibers exhibit diffused reflection, but, if a good color depth is given in accordance with the invention, these polyester fibers would exhibit an enhanced color depth.

The present invention can be applied to extremely fine polyester fibers. Recently, extremely fine polyester fibers are rated high because these give fabrics of a good and new touch. But, the conventional fabrics of extremely fine polyester fibers exhibit enhanced diffused reflection, and hence, have a light brownish color and a poor color depth. If a good color depth is given to extremely fine polyester fibers having a thickness below 1 denier, especially below 0.6 denier, in accordance with the present invention, the resulting fabrics exhibit a special color depth which could not be obtained with the conventional fabrics of extremely fine fibers, as well as a good touch. Thus, the polyester fabrics of the invention made of extremely fine fibers are of a sensuously and visually high grade.

EXAMPLES

The invention will now be described by the following examples.

Parameters used in the examples were determined as follows.

Light Transmittances XΠ, X⊥

Sample fibers are placed one by one in parallel on a slide glass, iodobenzene is dropped on the sample fibers and the fibers are covered with a covering glass sheet. Light transmittances are measured by using a polarization microspectroscope photometer "model DSP-SP-100-PO" supplied by Olympus Optical Co. A beam of polarized incident light having a diameter of 2 μm is projected to the fibers so that the beam is parallel to the fiber axis, and spectral transmittance is measured in the visible wavelength region of 400 to 700 nm, wherein the transmittance at the area where the fibers are not present is the reference transmittance. The transmittance at a wavelength corresponding to the minimum transmittance is XΠ (%). Similarly, a beam of polarized incident light is projected to the fibers so that the beam is perpendicular to the fiber axis, and the transmittance X⊥ (%) at a wavelength corresponding to the minimum transmittance in the visible wavelength region of 400 to 700 μm is measured.

Degree of Orientation of Entire Fiber (Birefringence Δn)

Birefringence Δn is determined by using a polarization electron microscope according to the Senarmont method.

Degree of Crystallinity χc

X-ray diffraction pattern was prepared by using an X-ray generator RAD-IIIA supplied by Rigaku Electric Co. combined with a counter PSDC system, and by employing 35 kv×10 mA, a CuKα-line Ni filter, and a divergent slit of 1 mm ϕ.

While the fibers are rotated in a plane perpendicular to the X-ray beam, the total diffused reflection is determined on the crystalline region (in the case of polyester filaments, the determination is carried out at $2\theta=10°$ to 40°). Similarly, the total diffused reflection is determined on the non-crystalline region. The degree of crystallinity χc is calculated according to the following equation.

$$\chi c\,(\%) = \frac{\text{Area of Crystalline Region} \times 1.130}{\text{Total Area} - \text{Area of Air Diffusion}} \times 100$$

Degree of Crystal Orientation Fc

Degree of crystal orientation is calculated from the following equation:

$$F_c(\%)=[(180°-H°)/180°]\times 100$$

wherein H° is the half-value width of an X-ray diffraction pattern in the (110) plane. Note, in an X-ray diffraction pattern in the (100) plane, the spot is not always concentrated on the equator and occasionally separated into upper and lower sides of the equator. Therefore, the diffraction in the (110) plane was employed.

Degree of Non-crystalline Orientation Δna

Degree of non-crystalline orientation Δna is calculated from the following equation $$\Delta na=(\Delta n-0.212Fc\chi c)/(1-\chi c).$$

Lightness Index L*

The ligntness index L* is defined by Commission Internationale de l'Eclairage (CIE) and determined according to JIS-Z-8729-1980. The larger the lightness index L* value, the lighter the fiber color. The smaller the L* value, the darker and deeper the fiber color. The lightness index L* value is measured by using a spectrophotomerter Macbeth® Color Eye.

Comparative Example 1

This comparative example corresponds to Run No. 1 in Table 1.

Polyethylene terephthalate was melt-spun into filaments at a spinning speed of 1,500 m/min. The filaments were drawn three times the original length wherein a part of the filaments were passed on a heated plate maintained at 160° C. and the other part thereof were not passed on a heated plate, whereby two kinds of drawn filaments were prepared, each kind being composed of 18 filaments with 30 denier in total. The two kinds of filaments having different shrinkability were mix-spun into a silky mixed polyester filament yarn composed of 36 filaments with 60 denier in total.

A gray fabric was woven from the silky mixed polyester filament yarn as both a warp and a weft. The gray fabric was scoured with boiling water using a surfactant under a relaxed condition and then set at 180° C. Thereafter the fabric was dyed under the following conditions.

Dyeing temperature: temperature was elevated at a rate of 2° C./rain from normal temperature, and dyeing was carried out at 130° C. for 60 min.

Dyestuff and amount: C. I. Disperse Red 92 with a molecular weight of 496; 5% owf Dyeing auxiliaries: Disper VG 0.5 g/l+acetic acid 0.2 ml/l Bath ratio: 1:50

After dyeing, the dyed fabric was washed under a reducing condition, dried and then set at 160° C. The resultant dyed fabric was silky, and exhibited a lightness index L* of 39.8, and a color depth Y of class 1 as expressed by 10 rating visual organoleptic test, provided that the color depth Y of silk is rated as class 7.

Figure 9:
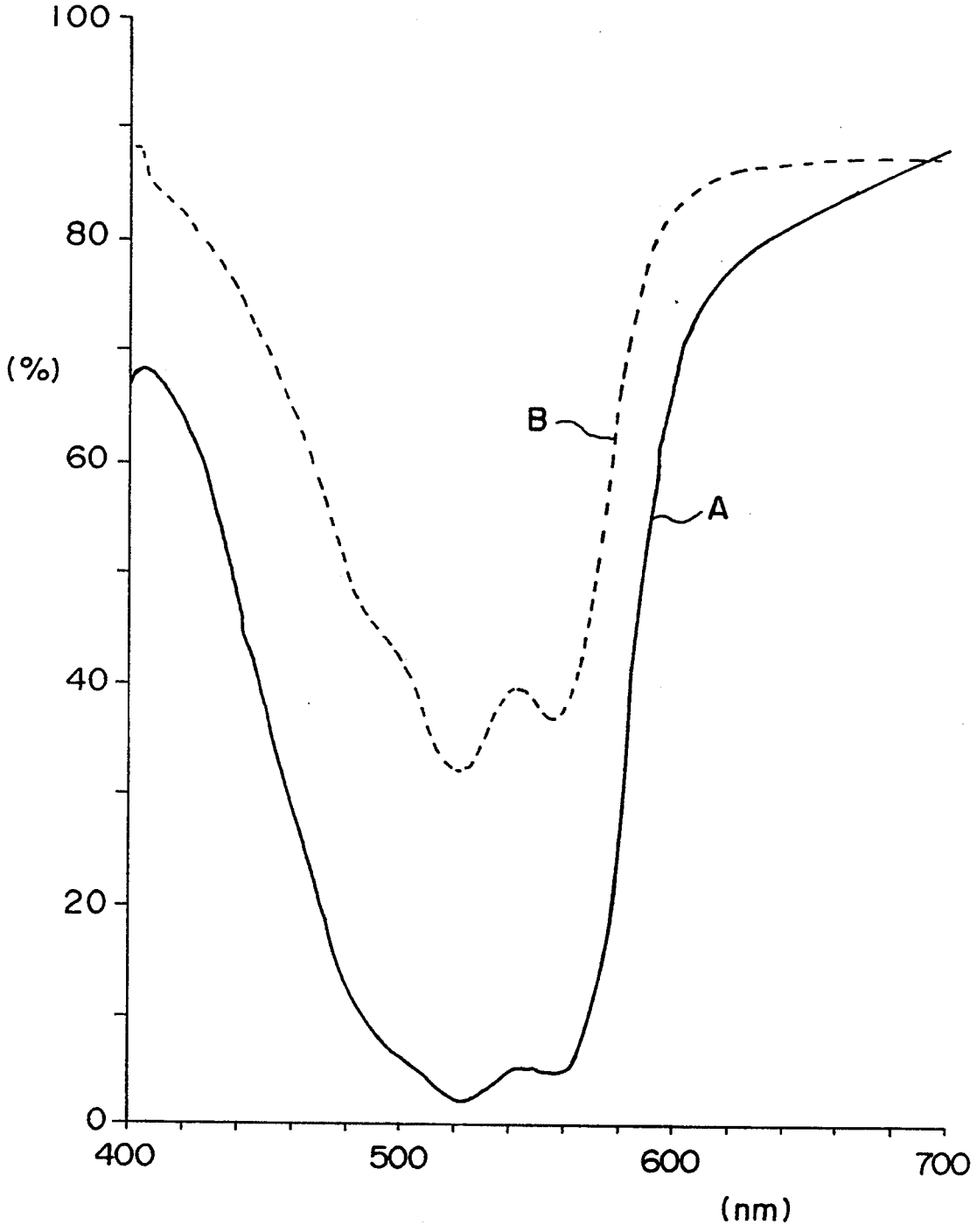
FIGS. 9 through 30 show graphs of light transmittances of fibers in the surface layer portions of the yarns of the dyed polyester fabrics made in Examples 1 through 8 and Comparative Examples 1 through 5, described below.

Dyed fibers were collected from the surface layer portion of the dyed fabric and the light transmittances XΠ and X⊥ were determined. The spectrum of polarized transmitted light in the direction parallel to the fiber axis and that in the direction perpendicular to the fiber axis in the visible light wavelength region (400 to 700 nm) are shown as A and B, respectively, in FIG. 9. The maximum absorption wavelength $\lambda_0$ (i.e., a wavelength corresponding to the minimum transmittance) was 520 nm. At the wavelength of 520 nm, the light transmittance XΠ of A was 2% and the light transmittance X⊥ of B was 32%. Thus, ΔX (=X⊥−XΠ) was 30%.

Comparative Example 2

This comparative example corresponds to Run No. 2 in Table 1.

Ultrafine particles of a water-soluble inorganic substance having a diameter not larger than 0.1 μm were uniformly dispersed in polyethylene terephthalate in an amount of 3% by weight. The polyethylene terephthalate was then melt-spun into filaments at a spinning speed of 1,200 m/rain by an ordinary spinning procedure and the filaments were drawn 3.6 times the original length to prepare a filament yarn composed of 36 filaments with 75 denier in total. A gray fabric was woven from the filament yarn as both a warp and a weft. The fabric was scoured, set at 180° C., and then treated with an aqueous sodium hydroxide solution having a concentration of 3% by weight at 100° C. for 20 minutes whereby the ultrafine particles of inorganic substance were dissolved and removed from the fibers. The thus-treated fabric was characterized as being composed of fibers having a rough surface with numberless ultrafine projections so that incident light was absorbed by the ultrafine projections. The fabric was dyed under the same conditions as employed in Comparative Example 1.

Figure 10:
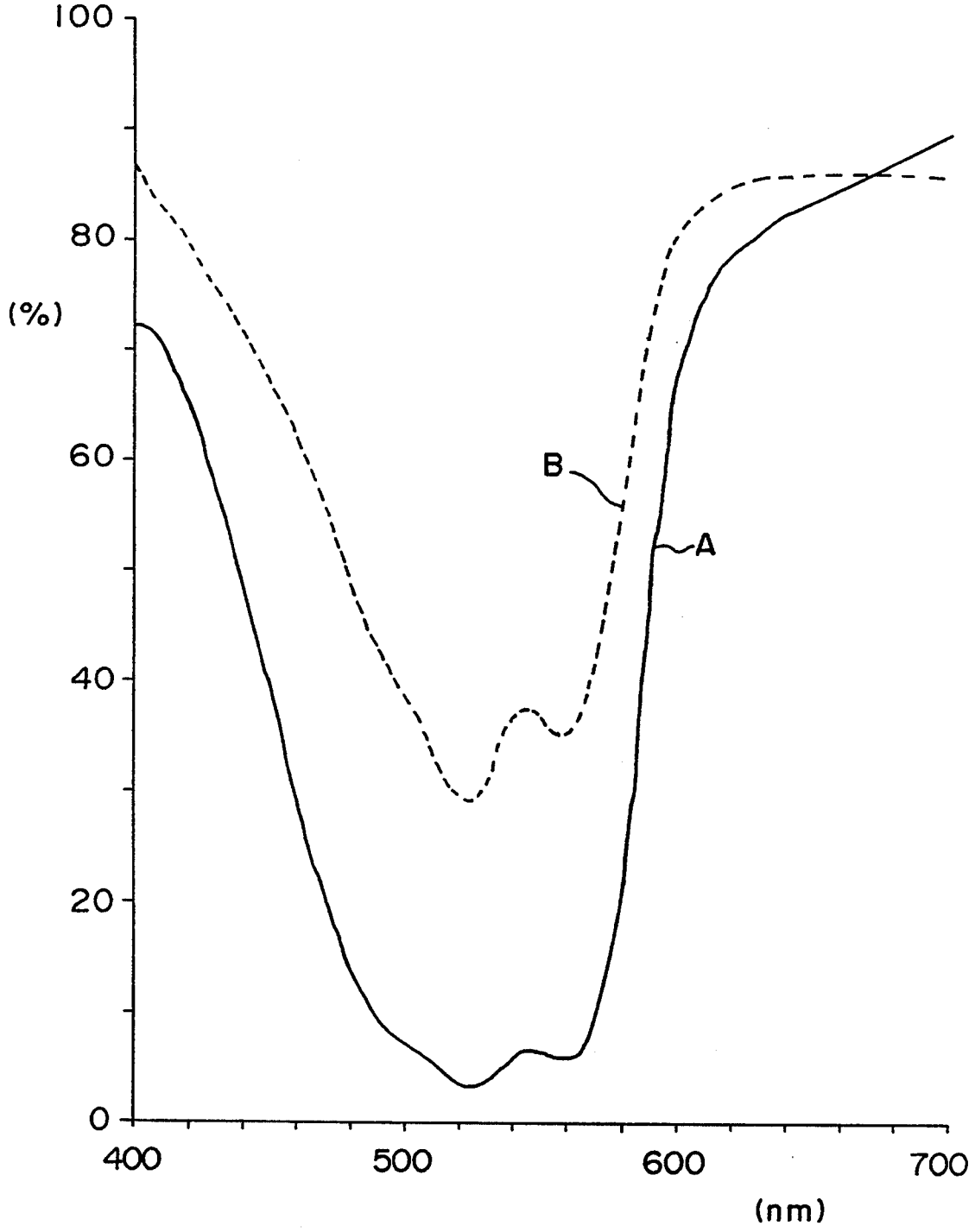

Light transmittances XΠ and X⊥ were determined on dyed fibers collected from the surface layer portion of the dyed fabric. The spectrum of transmitted light in the direction parallel to the fiber axis and that in the direction perpendicular to the fiber axis in the visible light wavelength region are shown as A and B, respectively, in FIG. 10. The maximum absorption wavelength $\lambda_0$ was 520 nm, namely, the same as that in Comparative Example 1 because of the same dyestuff. The difference in polarized light transmittance ΔX (=X⊥−XΠ) was relatively small, i.e., 27%. But, the dyed fabric had a color depth Y of class 2.

Comparative Example 3

This comparative example corresponds to Run No. 3 in Table 1.

Polyethylene terephthalate having copolymerized therewith 5% by mole of 5-sodium-sulfoisophthalic acid was melt-spun into filaments at a spinning speed of 2,500 m/min and the filaments were drawn 2.0 times the original length by an ordinary procedure to prepare a filament yarn having an improved dyeability composed of 24 filaments with 100 denier in total.

A gray fabric was woven from the filament yarn as both a warp and a weft. The fabric was scoured and dyed under the same conditions as employed in Comparative Example 1 except that the dyeing temperature was changed to 100° C.

Figure 11:
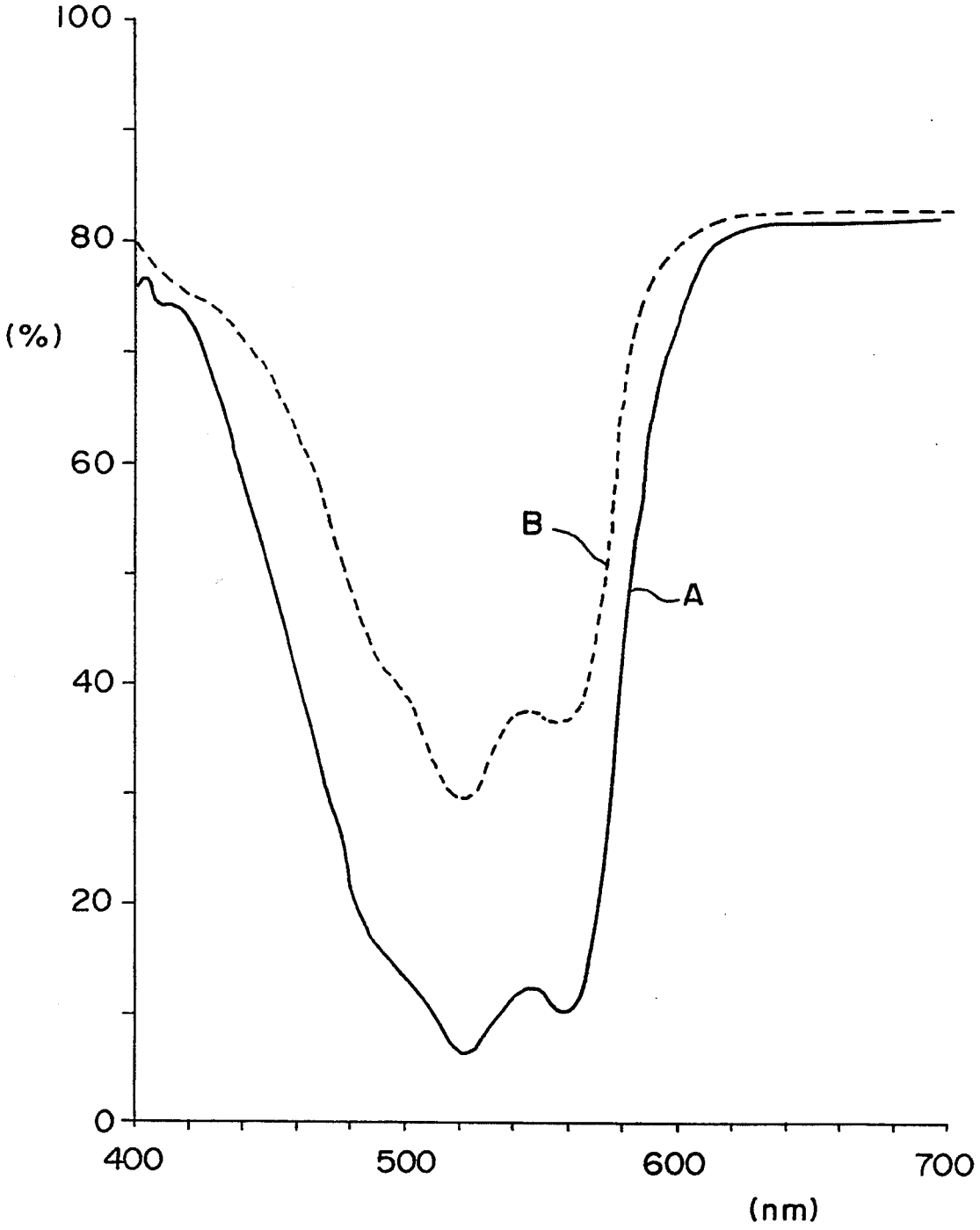

Light transmittances X⊥ and XΠ it were determined on dyed fibers collected from the surface layer portion of the dyed fabric. The spectrum of transmitted light in the direction parallel to the fiber axis and that in the direction perpendicular to the fiber axis in the visible light wavelength region are shown as A and B, respectively, in FIG. 11. The difference in polarized light transmittance ΔX was 23%. The color depth Y of the dyed fabric was class 3.

For comparison, the above-mentioned procedure was repeated wherein the dyeing temperature was raised to 130° C., but the results were rather unsatisfactory as compared with the above results.

Comparative Example 4

This comparative example corresponds to Run No. 4 in Table 1.

Polyethylene terephthalate was melt-spun into filaments at a spinning speed of 3,500 m/min, and the filaments were drawn 1.5 times the original length and heat-treated under a relaxed condition using a heater maintained at 180° C. to prepare a filament yarn composed of 24 filaments with 50 denier in total, which was characterized in that the non-crystalline region was self-elongatable. The filament yarn was mix spun with a highly shrinkable polyester filament yarn composed of 12 filaments with 30 denier in total to prepare a mixed yarn of filaments having different shrinkabilities (36 filaments with 80 denier in total).

A gray fabric was woven from the mixed filament yarn as both a warp and a weft. The fabric was scoured and dyed under the same conditions as employed in Comparative Example 1.

Figure 12:
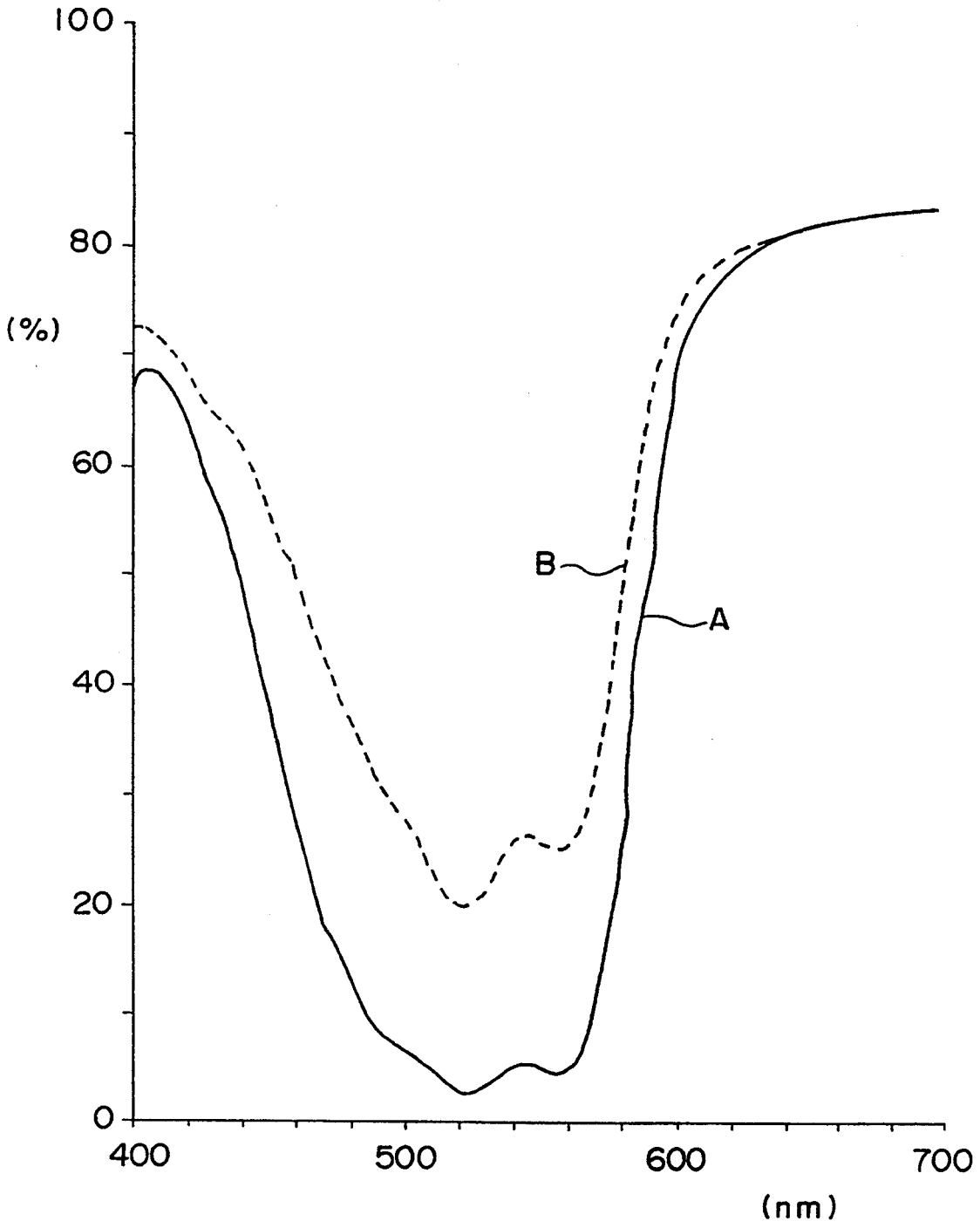

The resultant dyed fabric was soft and had a good drapability and touch, which is classified into a fabric of a new synthetic fiber. Light transmittances X⊥ and XΠ were determined on dyed fibers collected from the surface layer portion of the dyed fabric. The spectrum of transmitted light in the direction parallel to the fiber axis and that in the direction perpendicular to the fiber axis in the visible light wavelength region are shown as A and B, respectively, in FIG. 12. The difference in polarized light transmittance ΔX was 17%. The color depth Y of the dyed fabric was class 5, and thus, poor as compared with that of silk.

Comparative Example 5

This comparative example corresponds to Run No. 5 in Table 1.

Polyethylene terephthalate was melt-spun into filaments at a spinning speed of 7,000 m/min so as to obtain filaments exhibiting a very high rate of dye absorption, whereby a deeply dyeable filament yarn composed of 24 filaments with 50 denier in total.

A gray fabric was woven from the filament yarn as both a warp and a weft. The fabric was scoured and dyed under the same conditions as employed in Comparative Example 1 except that the dyeing temperature was changed to 110° C.

Figure 13:
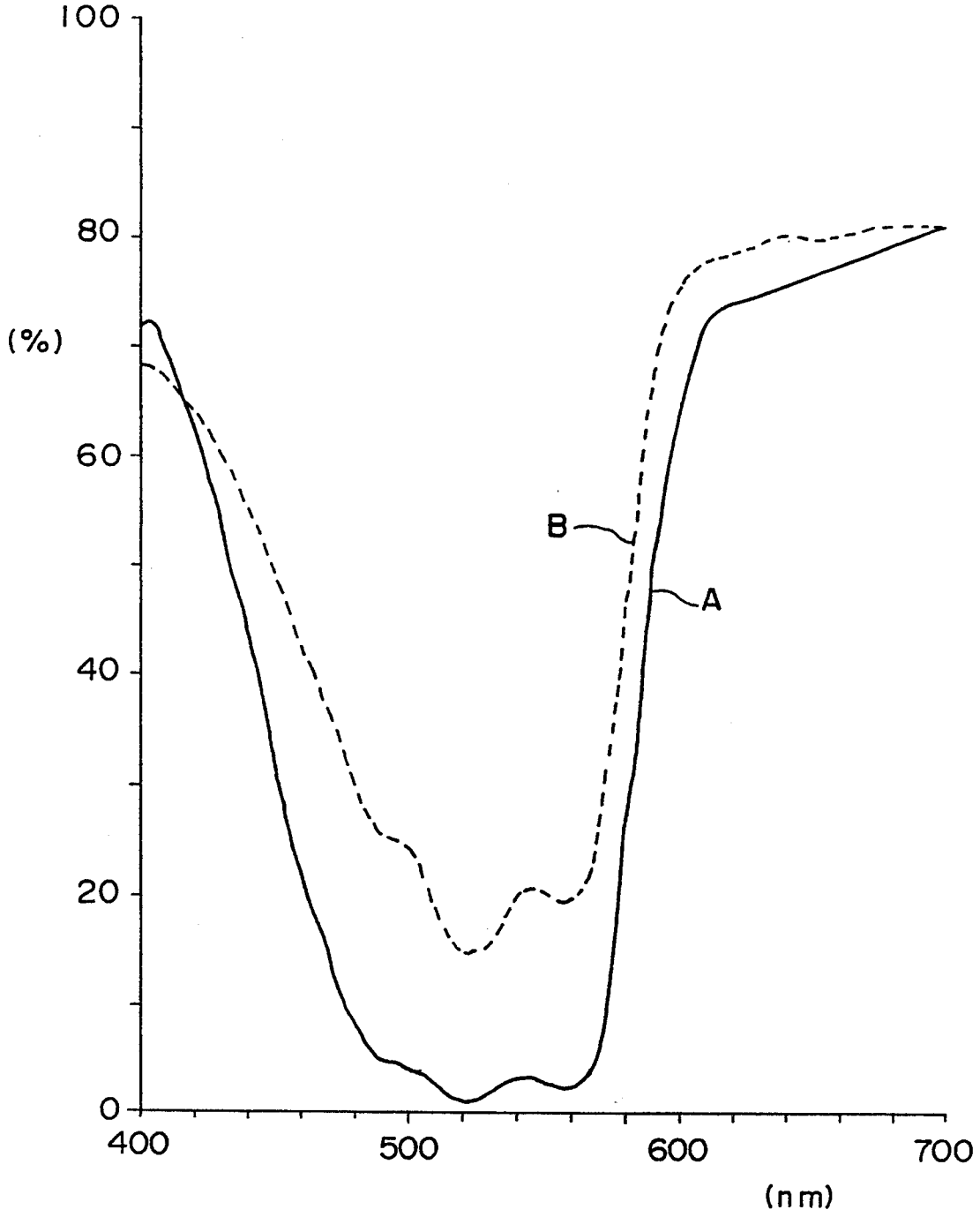

The resultant fabric had a soft touch which was characteristic to filaments spun at a ultra-high spinning speed. The fabric could be dyed at 110° C. and exhibited a color index L* of 38.5, but the coloring was not deep, namely the color depth Y value was class 5. Light transmittances X⊥ and XΠ were determined on dyed fibers collected from the surface layer portion of the dyed fabric. The spectrum of transmitted light in the direction parallel to the fiber axis and that in the direction perpendicular to the fiber axis in the visible light wavelength region are shown as A and B, respectively, in FIG. 13. The difference in polarized light transmittance ΔX was 14%.

For comparison, the above-mentioned procedure was repeated wherein the dyeing temperature was raised to 130° C., but the results were similarly unsatisfactory.

Example 1

This example corresponds to Run No. 6 in Table 1.

Polyethylene terephthalate was melt-spun into filaments at a spinning speed of 2,500 m/min. The filaments were heat-treated at 220° C. for 0.05 second as they were in an undrawn state to prepare an undrawn polyester filament yarn composed of 24 filaments with 30 denier in total. The filament yarn was mix-spun with a highly shrinkable polyester filament yarn having an elongation of 25% composed of 12 filaments with 30 defiler in total, to prepare a polyester filament yarn composed of 36 filaments with 60 denier in total.

A gray fabric was woven from the polyester filament yarn as both a warp and a weft. The gray fabric was scoured and dyed under the same conditions employed in Comparative Example 1.

Figure 14:
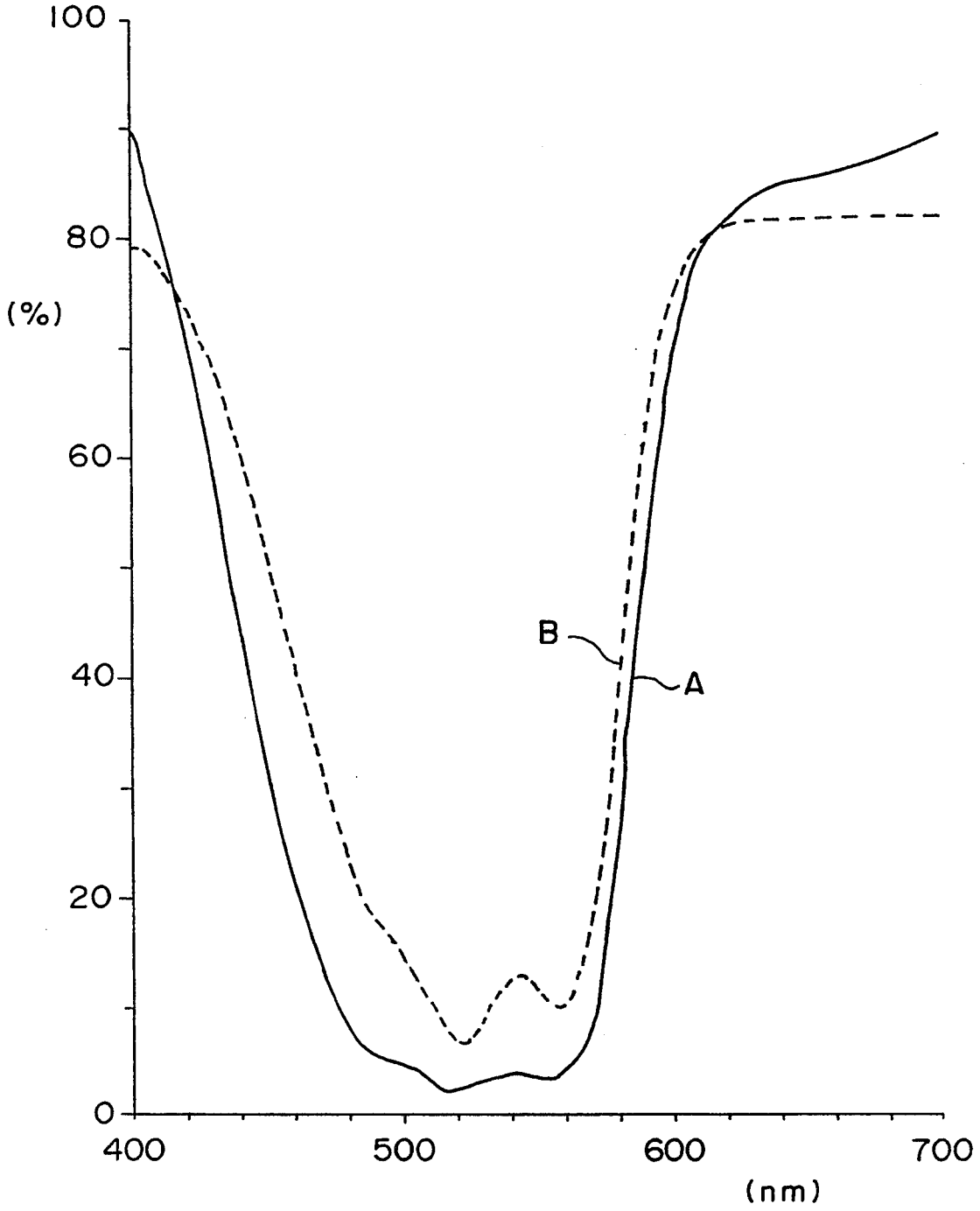

The dyed fabric was bulky and was composed of two types of filaments having different lengths $l_3$ and $l_2$ wherein the difference in % of $(l_2-l_1)$ was 15%. Light transmittances X⊥ and XII were determined on dyed fibers collected from the surface layer portion of the dyed fabric. The spectrum of transmitted light in the direction parallel to the fiber axis and that in the direction perpendicular to the fiber axis in the visible light wavelength region are shown as A and B, respectively, in FIG. 14. The difference in polarized light transmittance ΔX was only 5%. The dyed fabric exhibited a color depth Y of class 9. Namely, the fabric was more deeply and brilliantly dyed than silk, and far more deeply and brilliantly dyed than conventional synthetic fibers.

Example 2

This example corresponds to Run No. 7 in Table 1.

Polyethylene terephthalate was melt-spun into filaments at a spinning speed of 2,800 m/min. The filaments were heat-treated by a heater maintained at 240° C. as they were in an undrawn shake under relaxed conditions such that the overfeed ratio was 15%, whereby an undrawn polyester filament yarn was obtained which was composed of 24 filaments with 50 denier in total and characterized in that the non-crystalline region was completely non-oriented. The filament yarn was mix-spun with a highly shrinkable polyester filament yarn having an elongation of 27% composed of 10 filaments with 40 denier in total, to prepare a polyester filament yarn composed of 34 filaments with 90 denier in total.

A gray fabric was woven from the polyester filament yarn as both a warp and a weft. The gray fabric was scoured and dyed under the same conditions employed in Comparative Example 1.

Figure 15:
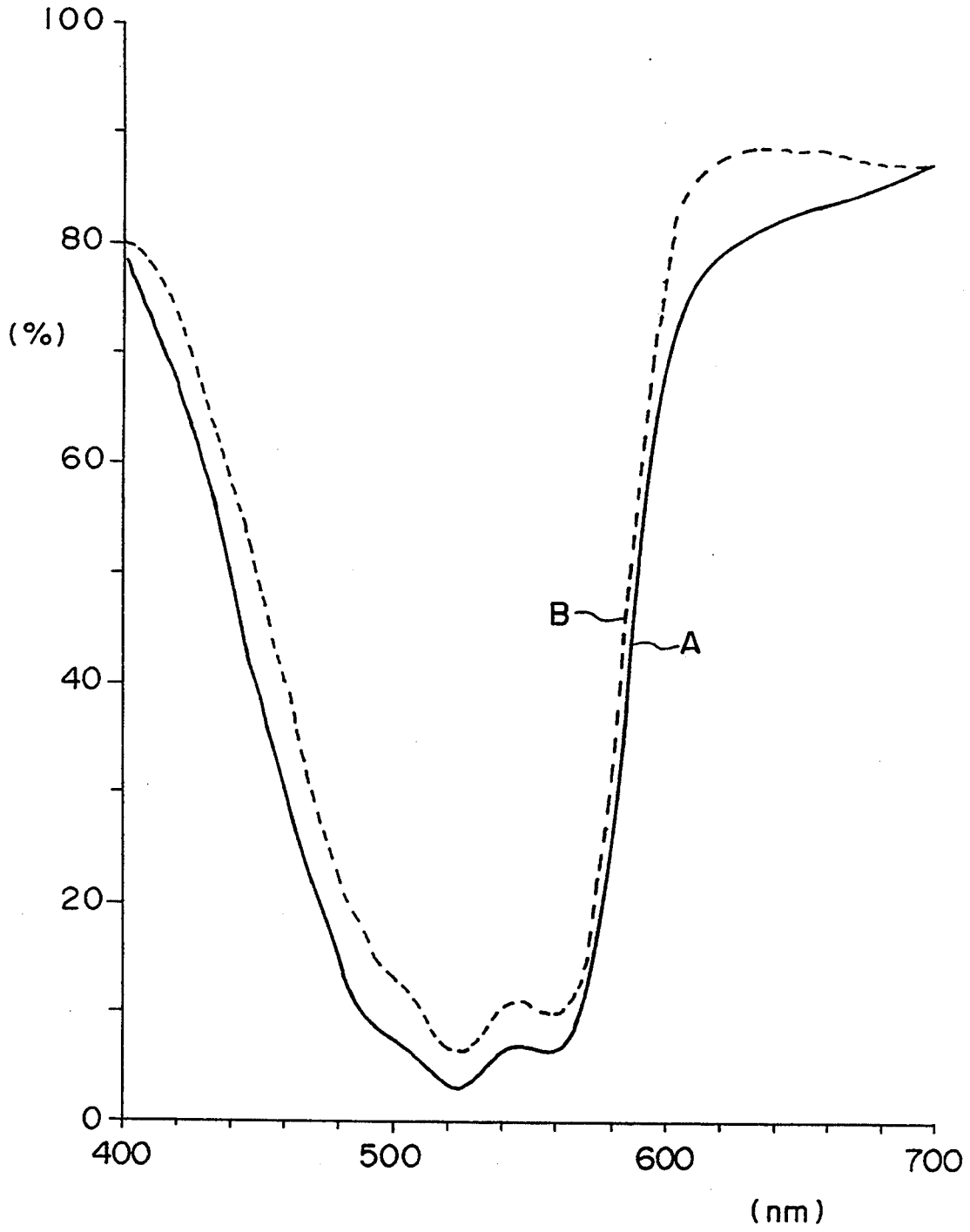

The dyed fabric was bulky and soft and had a good drapability. The dyed fabric had an appearance similar to those of new synthetic fibers, and was composed of two types of filaments having different lengths $l_1$ and $l_2$, wherein the difference of $(l_2-l_1)$ was 18%. The dyed fabric exhibited a color depth Y of class 10, namely, the fabric was much more deeply and brilliantly dyed than silk. Light transmittances X⊥ and XII were determined on dyed fibers collected from the surface layer portion of the dyed fabric. The speckrum of transmitted light in the direction parallel to the fiber axis and that in the direction perpendicular to the fiber axis in the visible light wavelength region are shown as A and B, respectively, in FIG. 15. The difference in polarized light transmittance ΔX was only 3%, namely, the transmittance was almost isotropic.

Example 3

Dyed fabrics of different colors were made by substantially the same procedure as described in Example 1 wherein the dyestuffs listed in Table 2 were used. The results are shown in Table 2.

TABLE 2

Figure 16:
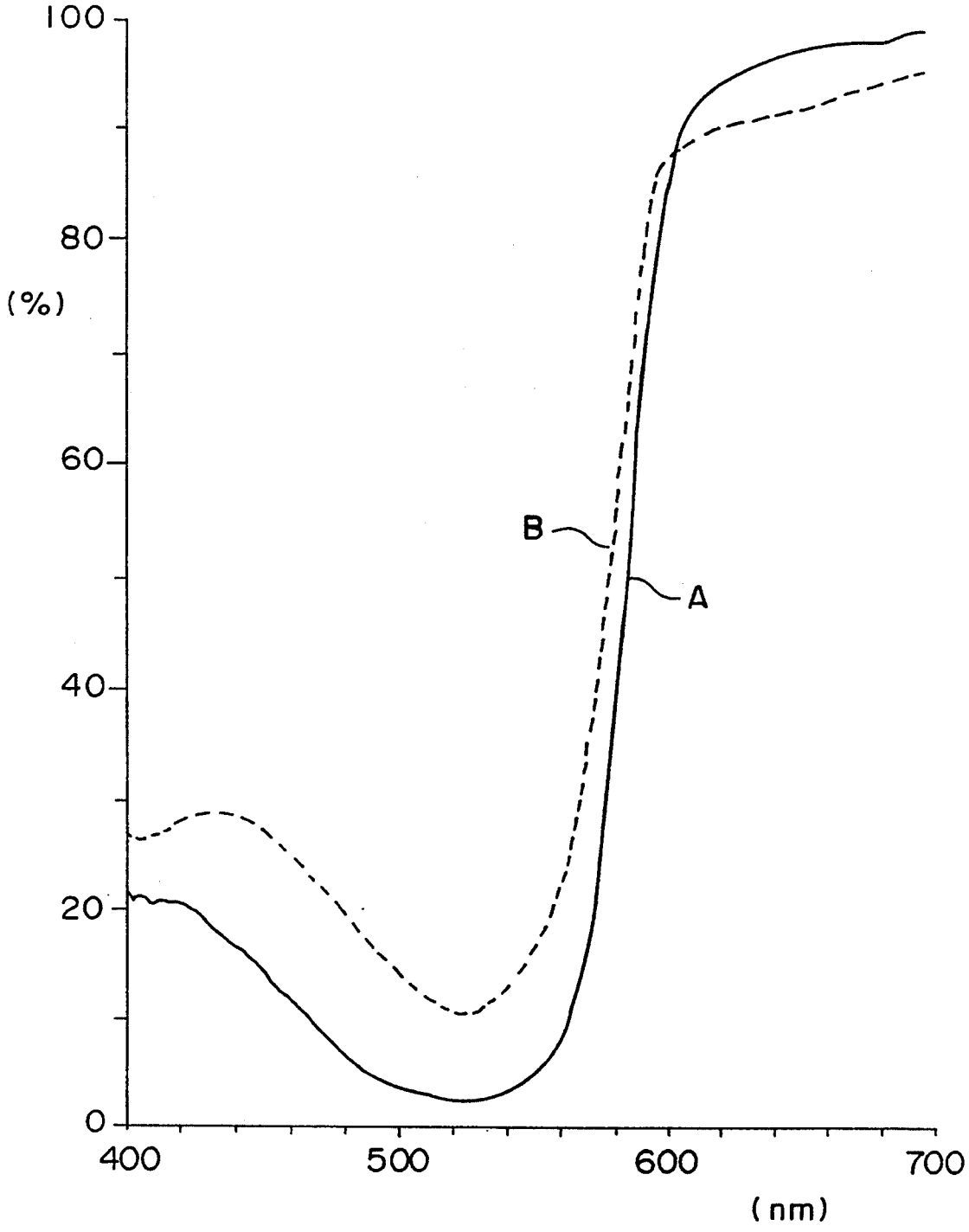
Figure 17:
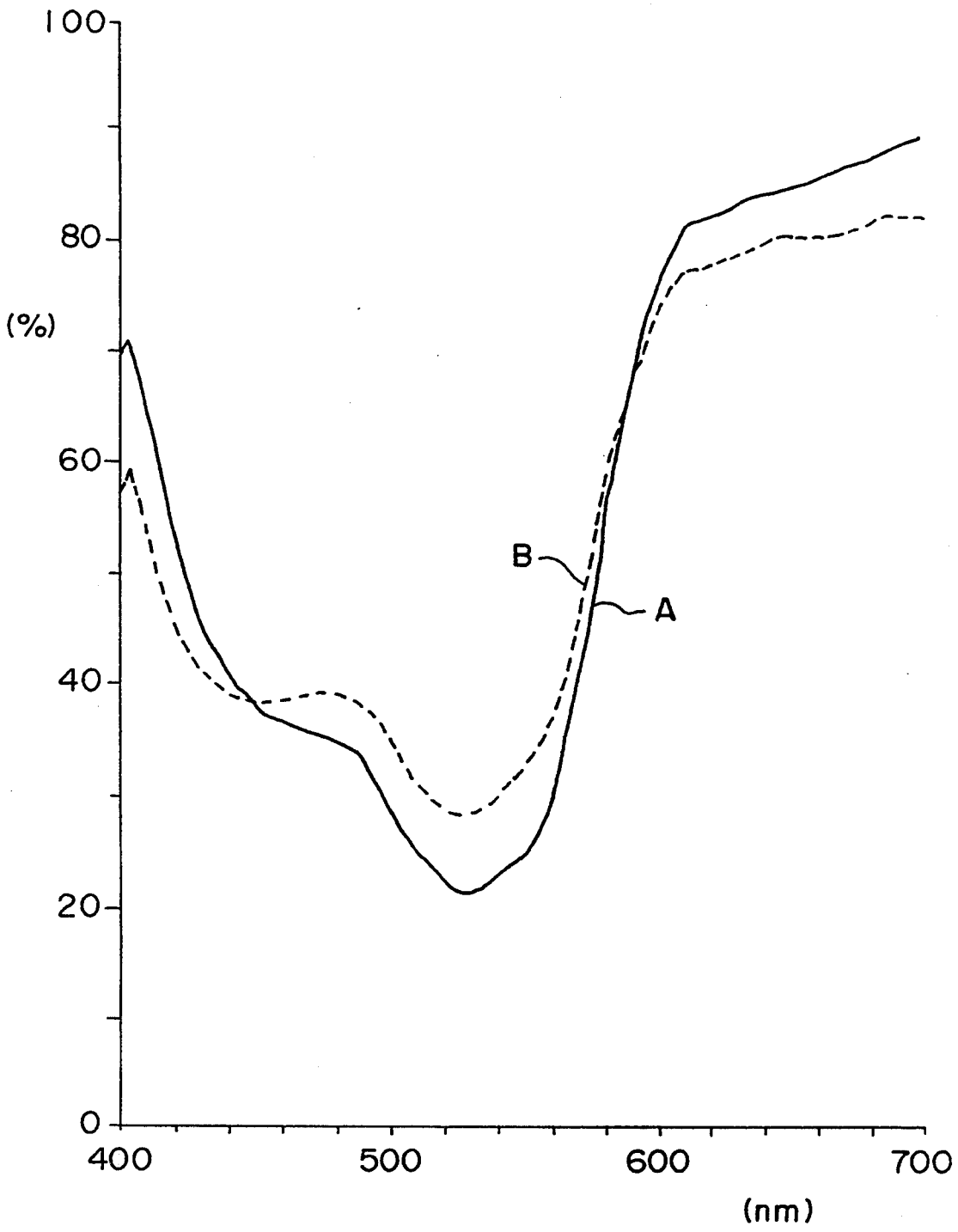
Figure 18:
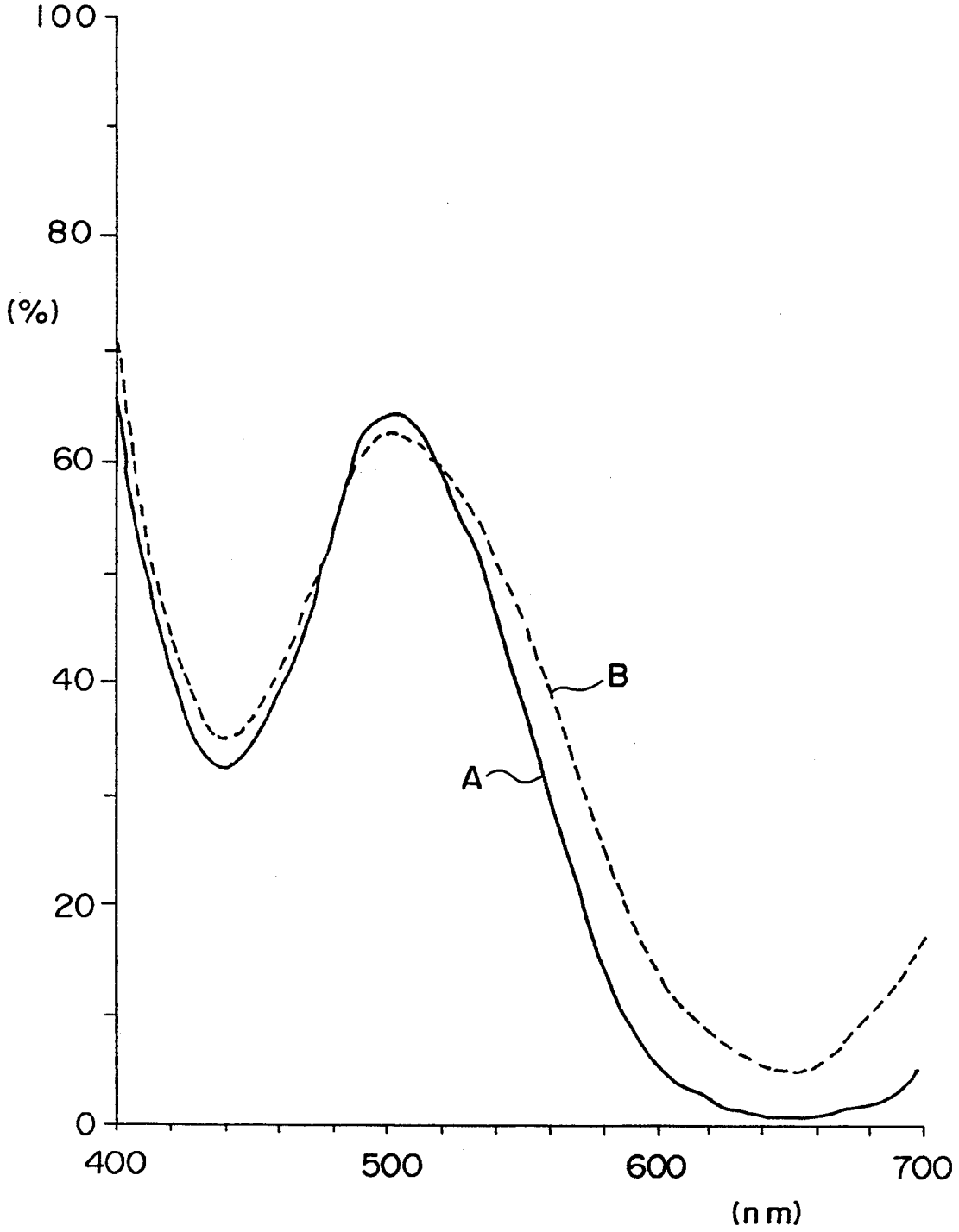
Figure 19:
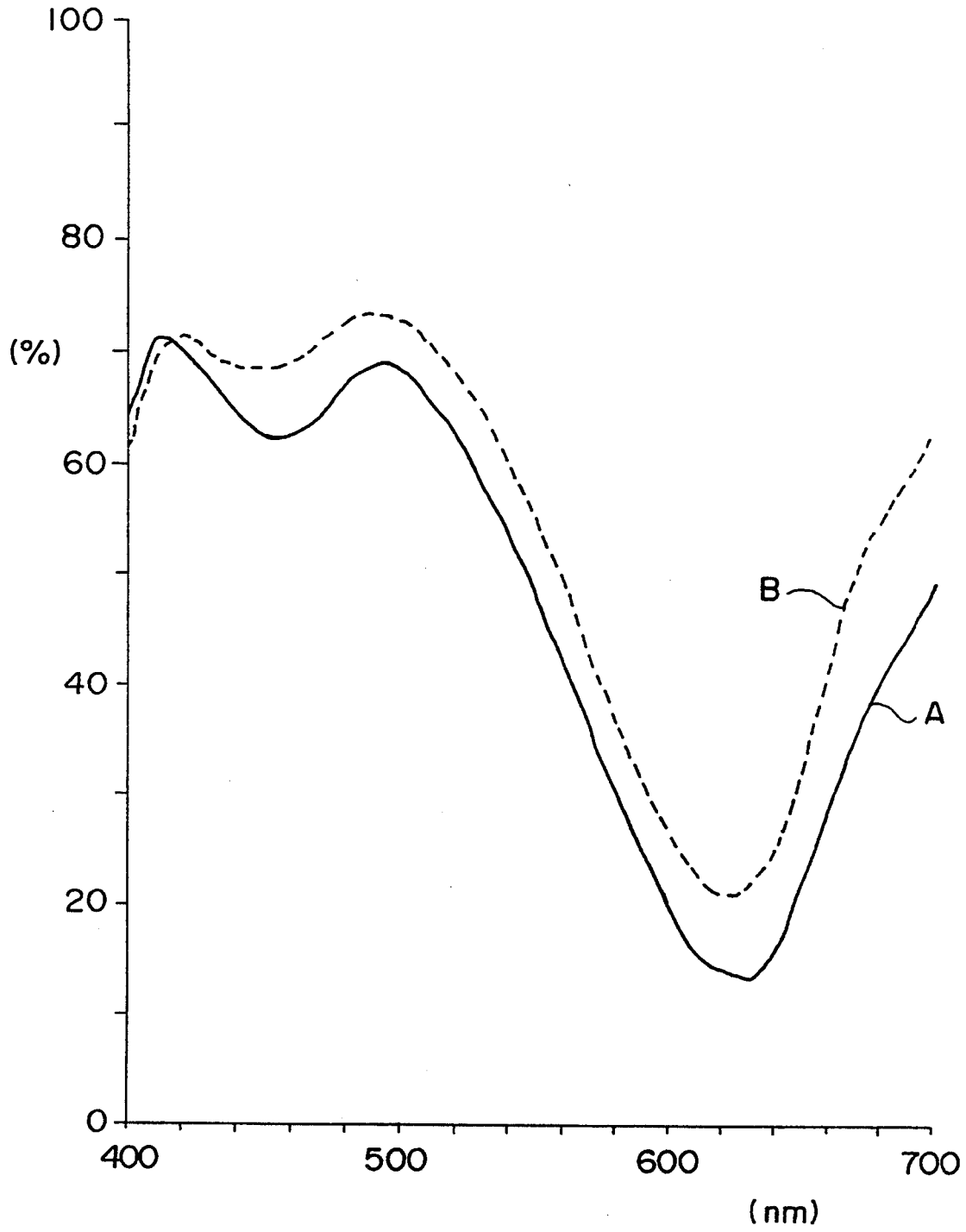
Figure 20:
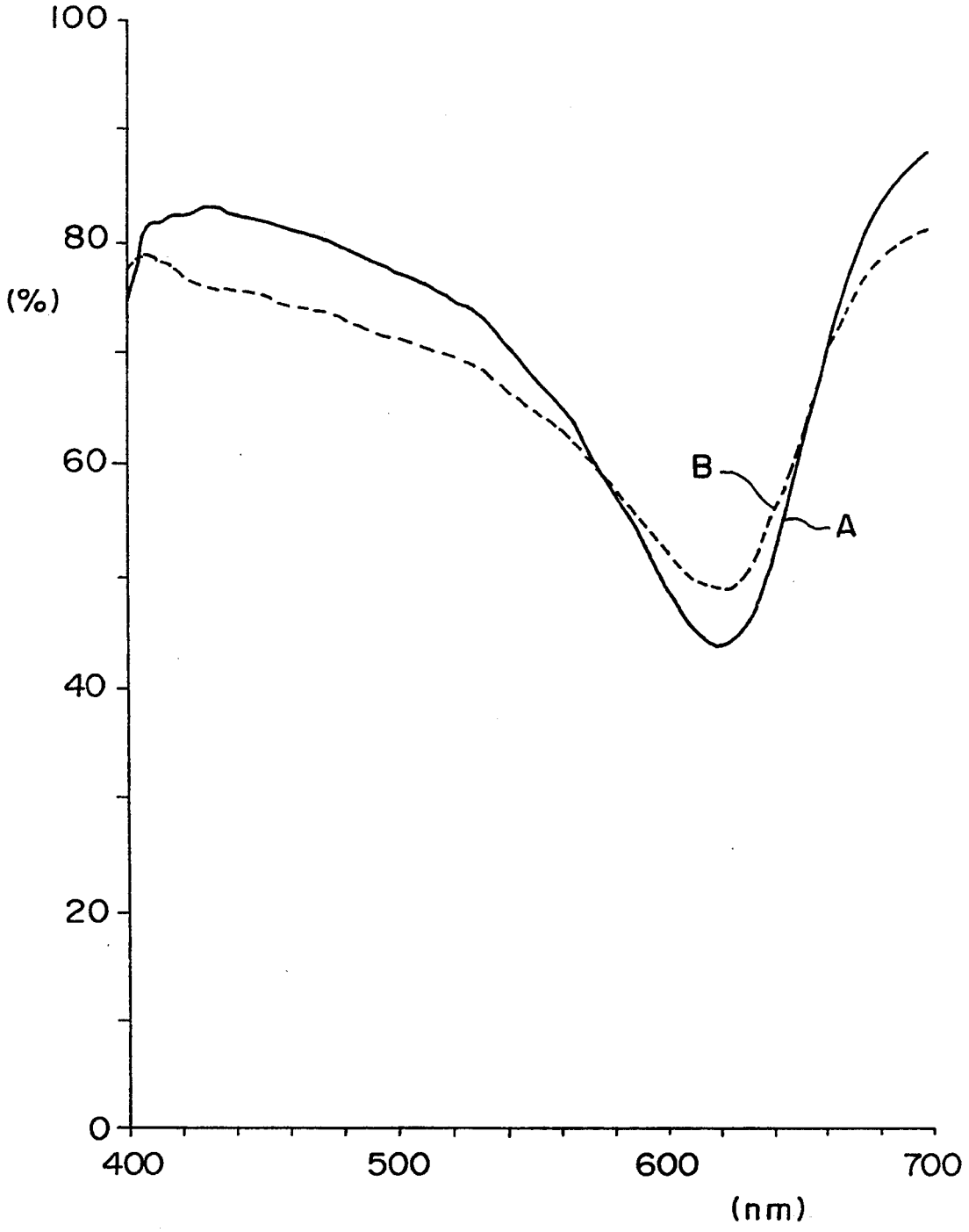
Figure 21:
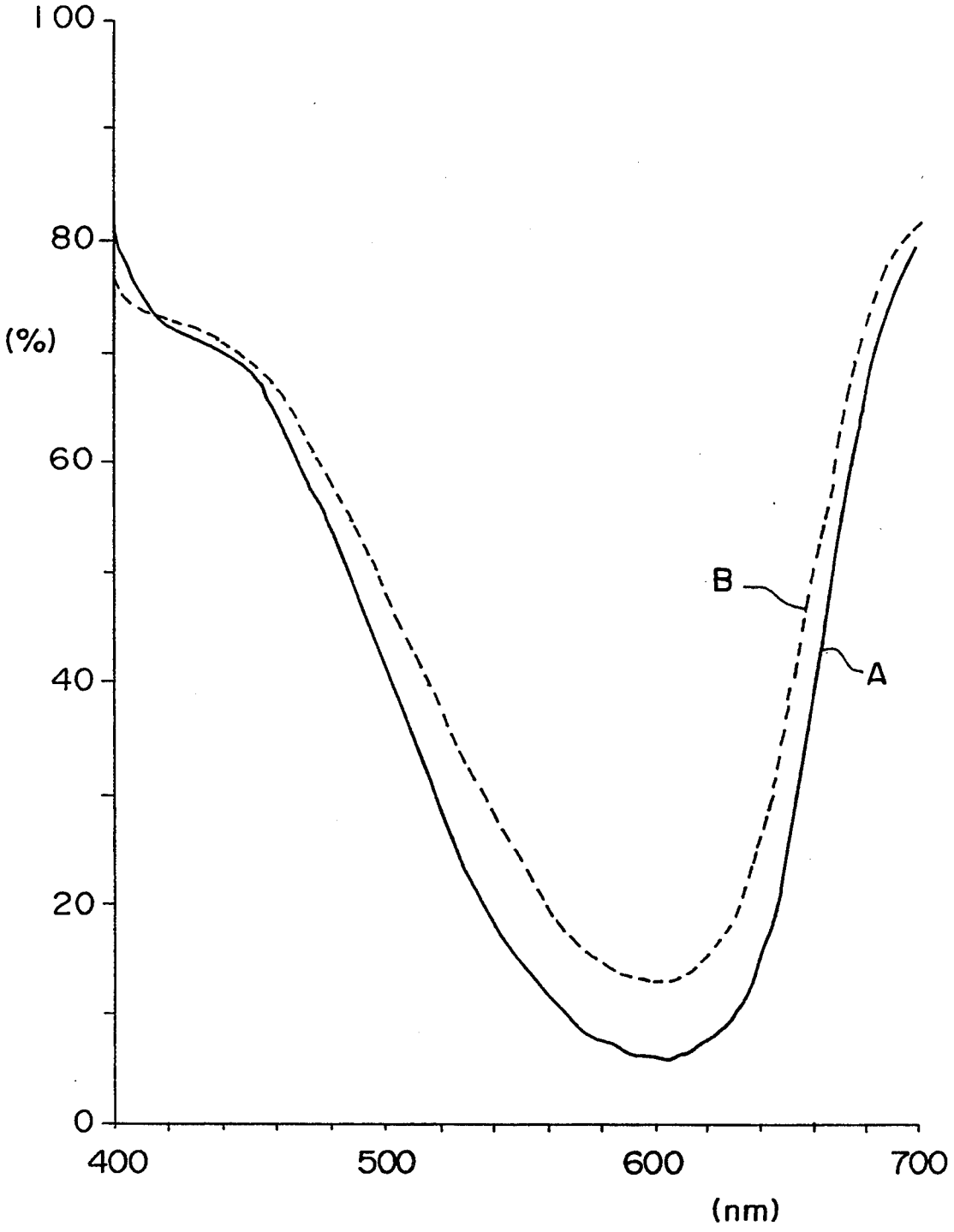
Figure 22:
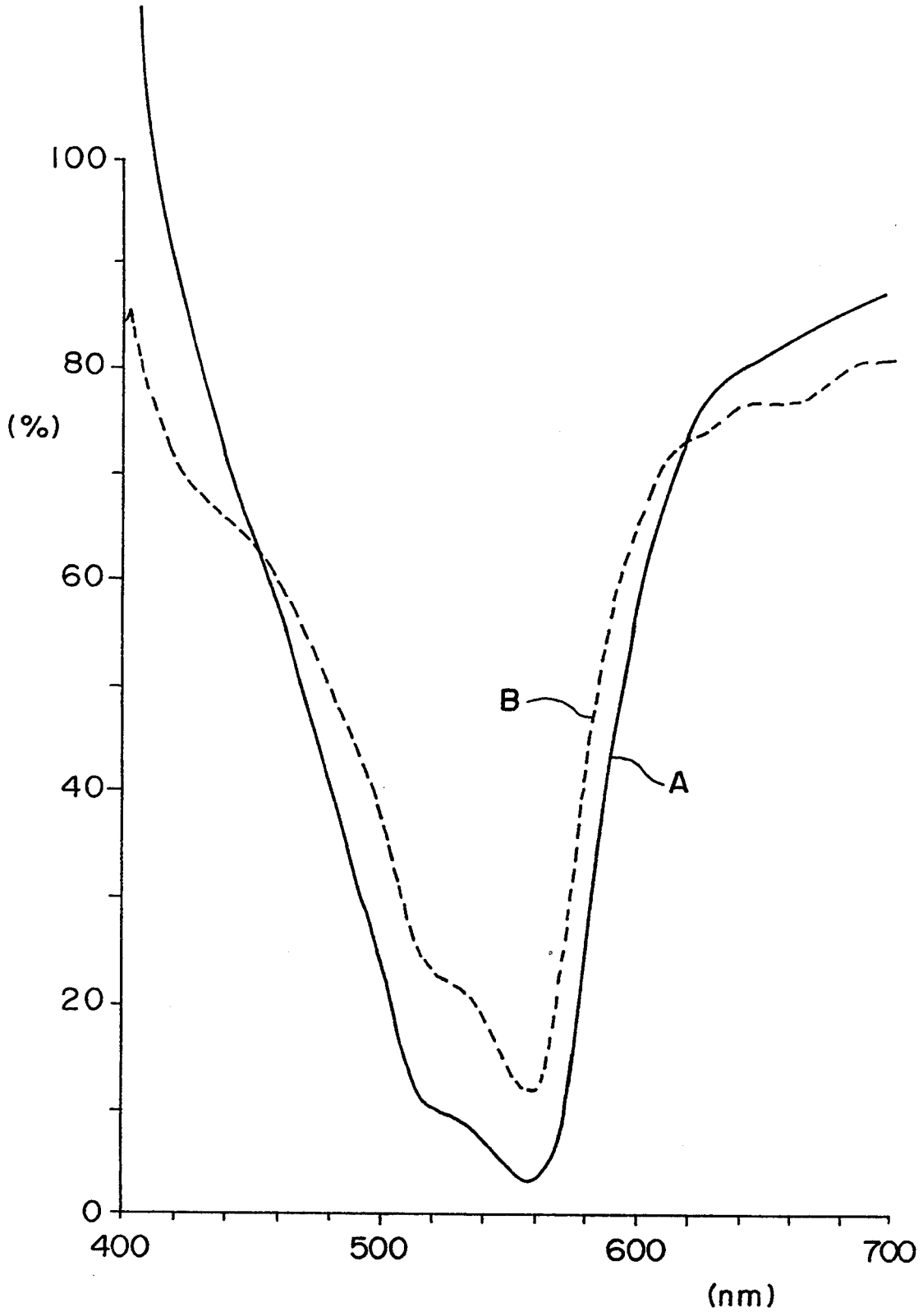

| Color | Dyestuff | Molecular weight | Spectrum of transmitted light | ΔX (%) | Y (class) |
|---|---|---|---|---|---|
| Scarlet | C.I.Disperse Red 356 | 398 | FIG. 16 | 8 | 8 |
| Orange | C.I.Disperse Red 356 (60%) + Yellow 23 (40%) | 360 | FIG. 17 | 6 | 7 |
| Green | C.I.Disperse Blue 354 (50%) + Yellow 23 (60%) | 402 | FIG. 18 | 4 | 10 |
| Cobalt green | C.I.Disperse Blue 354 (80%) + Yellow 23 (20%) | 461 | FIG. 19 | 7 | 9 |
| Sky blue | C.I.Disperse Blue 354 | 501 | FIG. 20 | 6 | 7 |
| Dark blue | C.I.Disperse Blue 165 | 404 | FIG. 21 | 8 | 8 |
| Violet | C.I.Red 92 (50%) + C.I. Violet 26 (50%) | 459 | FIG. 22 | 9 | 8 |

As seen from the examples of the invention, the requirement of difference in polarized light transmittance $\Delta X \leqq 10\%$ and the effect of color depth $Y \geqq 7$ are satisfied in all of the colors.

For comparison, dyed fabrics of different colors were made by substantially the same procedure as described in Comparative Example 1 and by using the same dyestuffs listed in Table 2. The results are shown in Table 3.

As seen from Table 3, the difference in polarized light transmittance ΔX exceeds 10 and the color depth Y is only in the range of class 1 to class 3 in all of the colors.

TABLE 3

Figure 23:
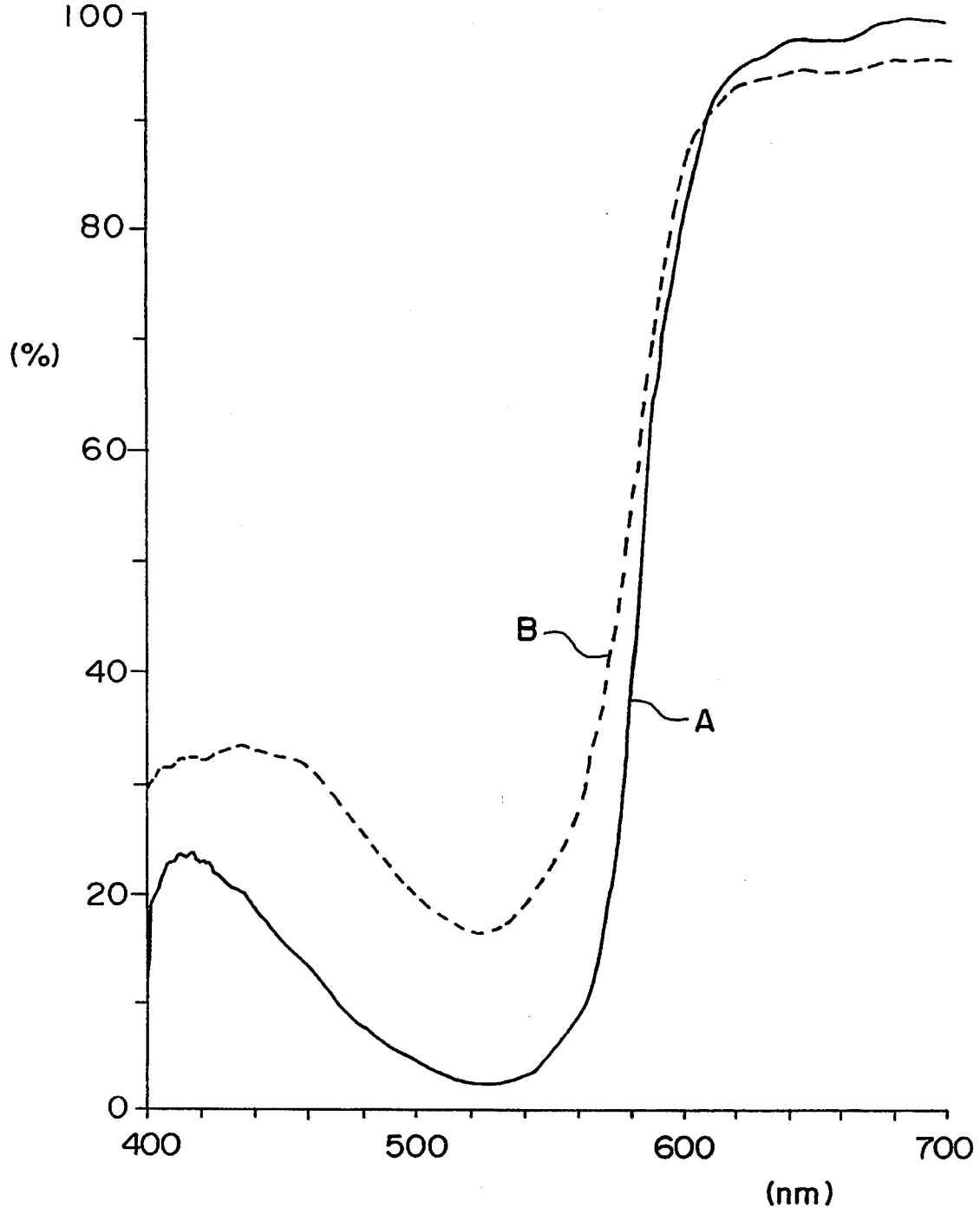
Figure 24:
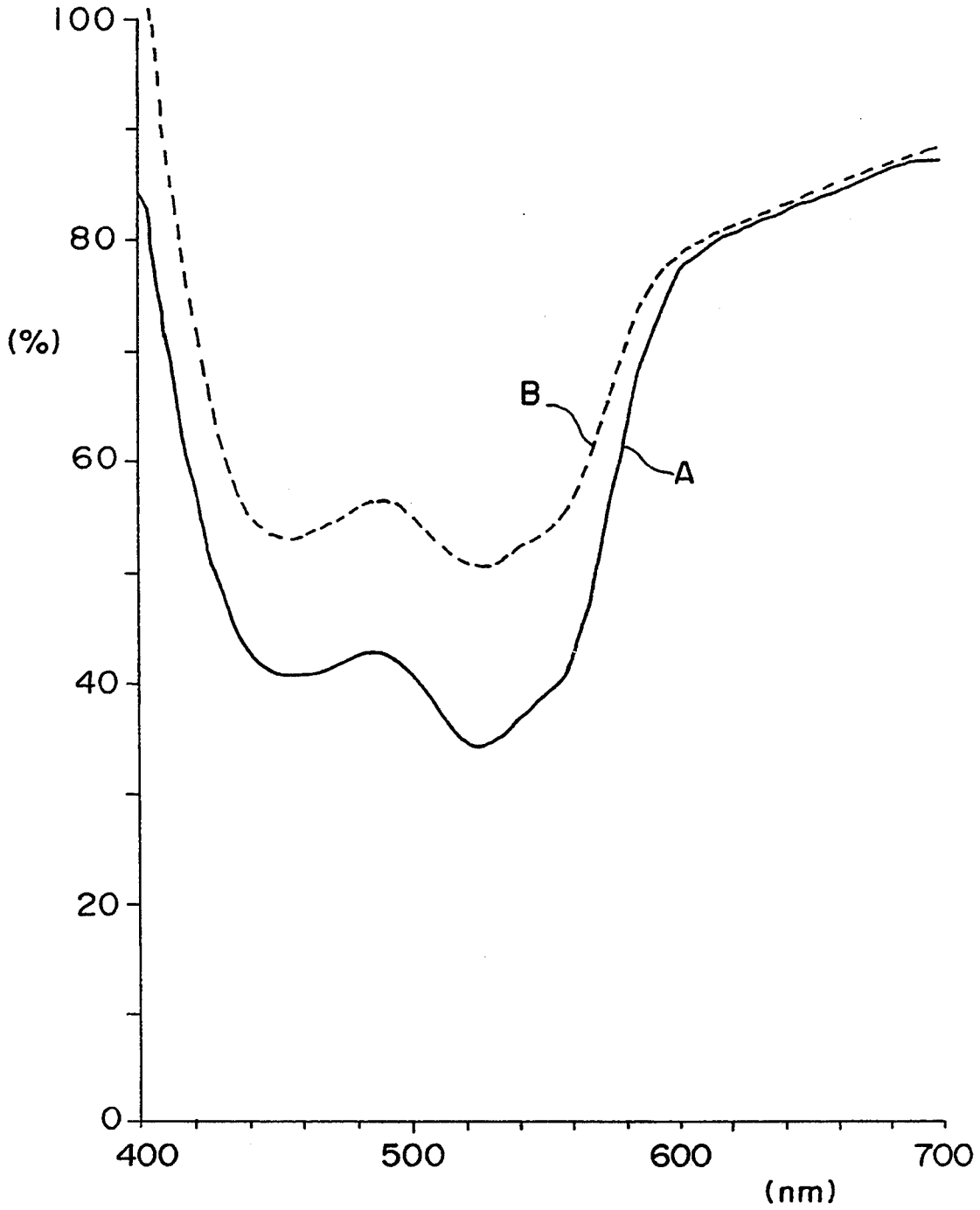
Figure 25:
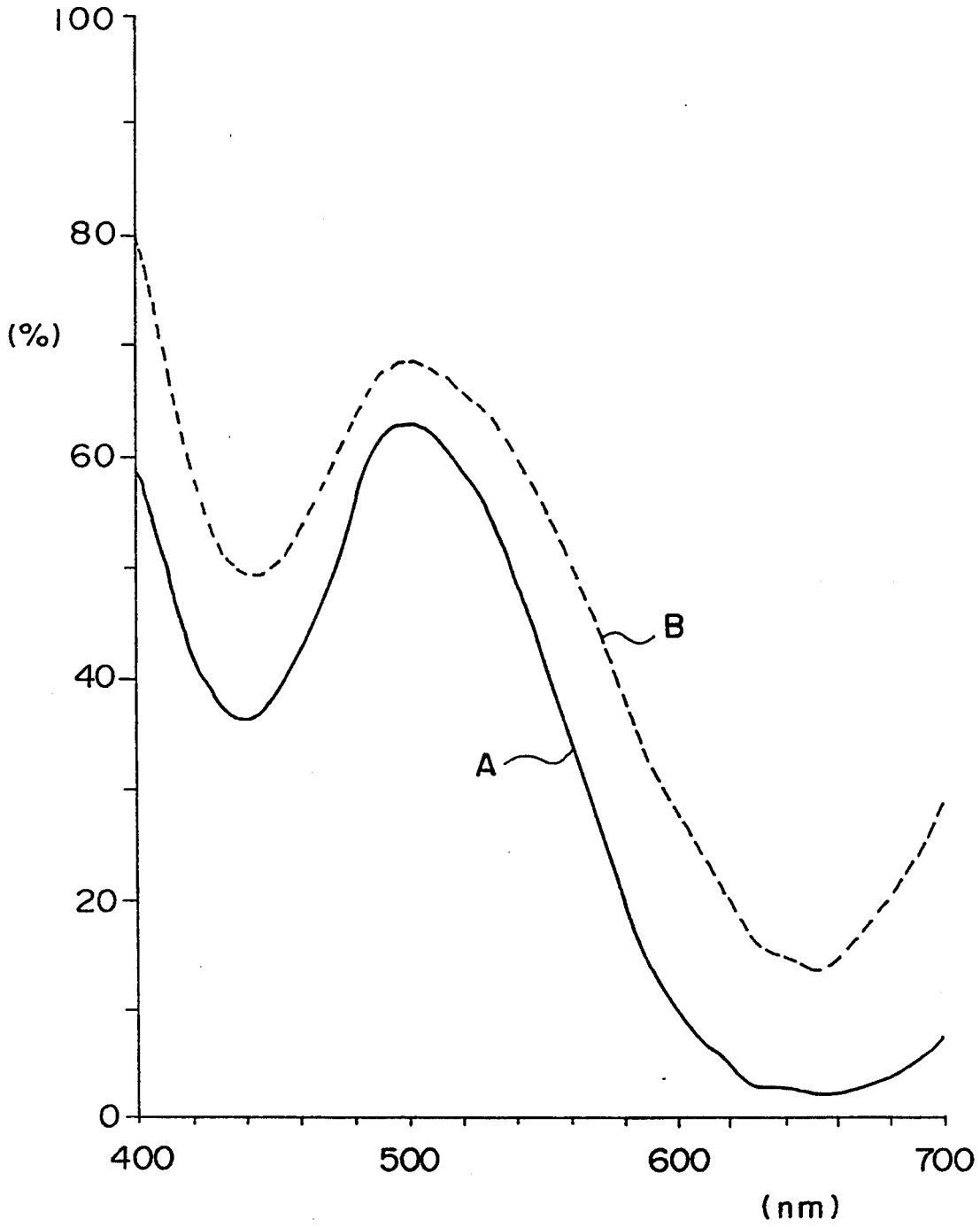
Figure 26:
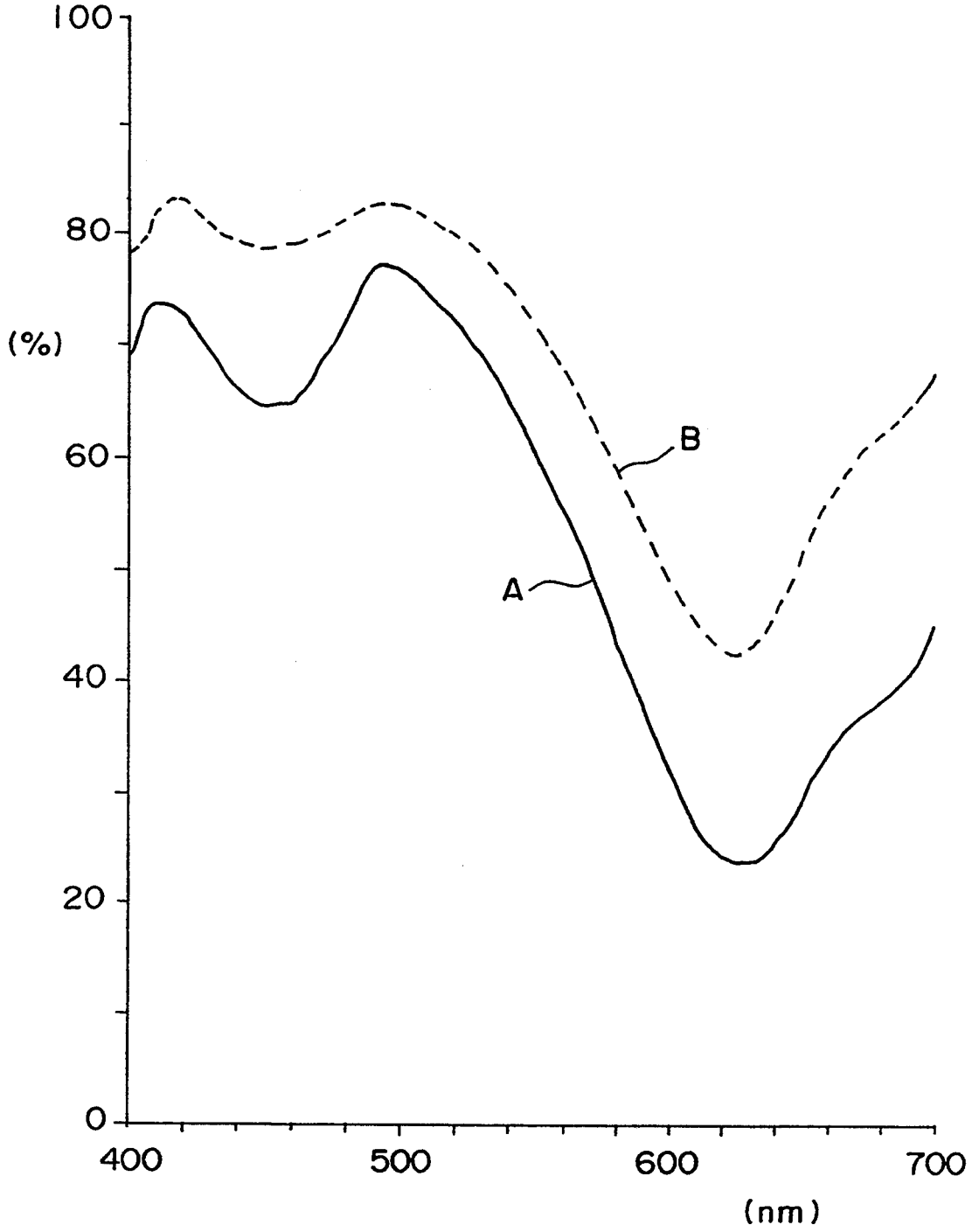
Figure 27:
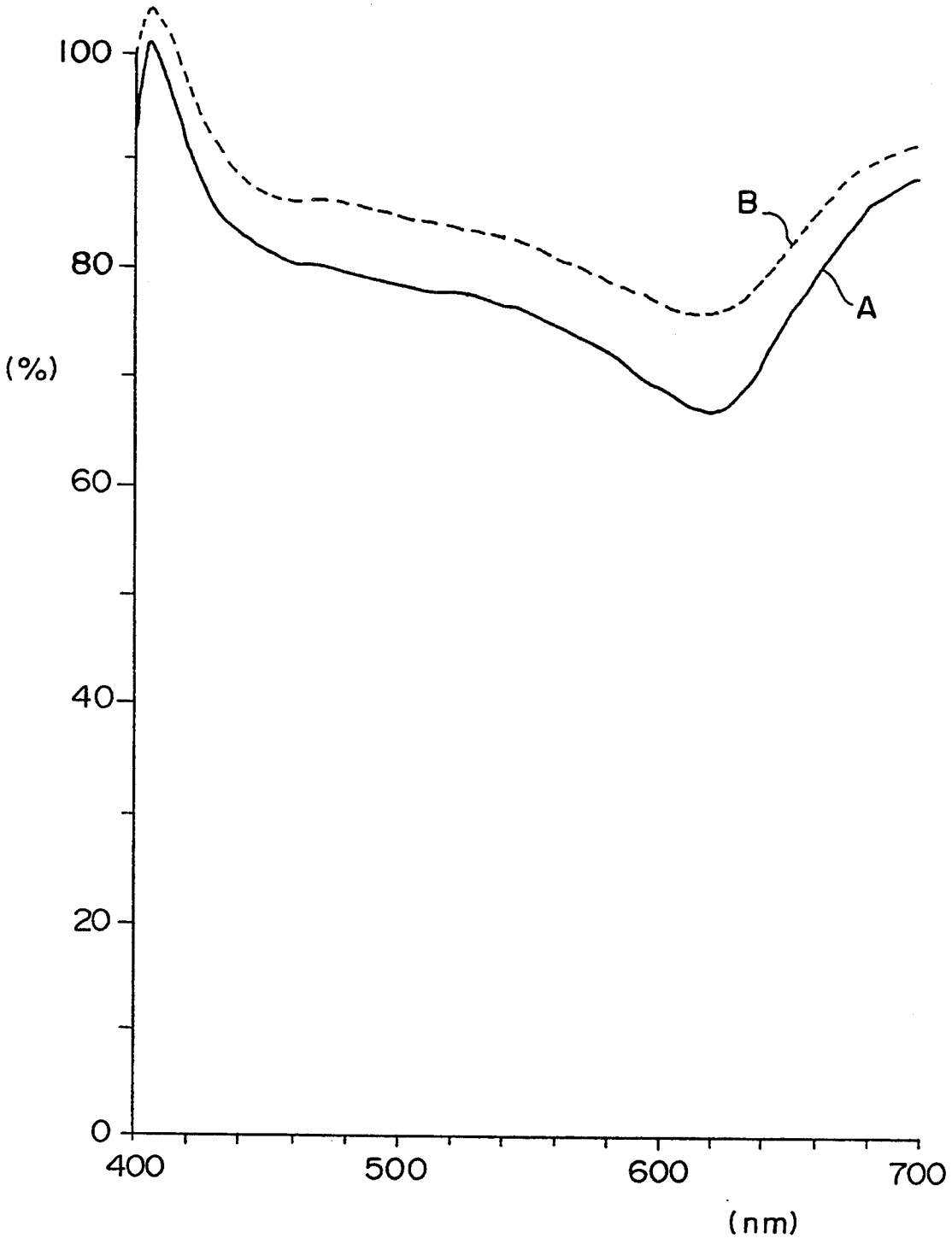
Figure 28:
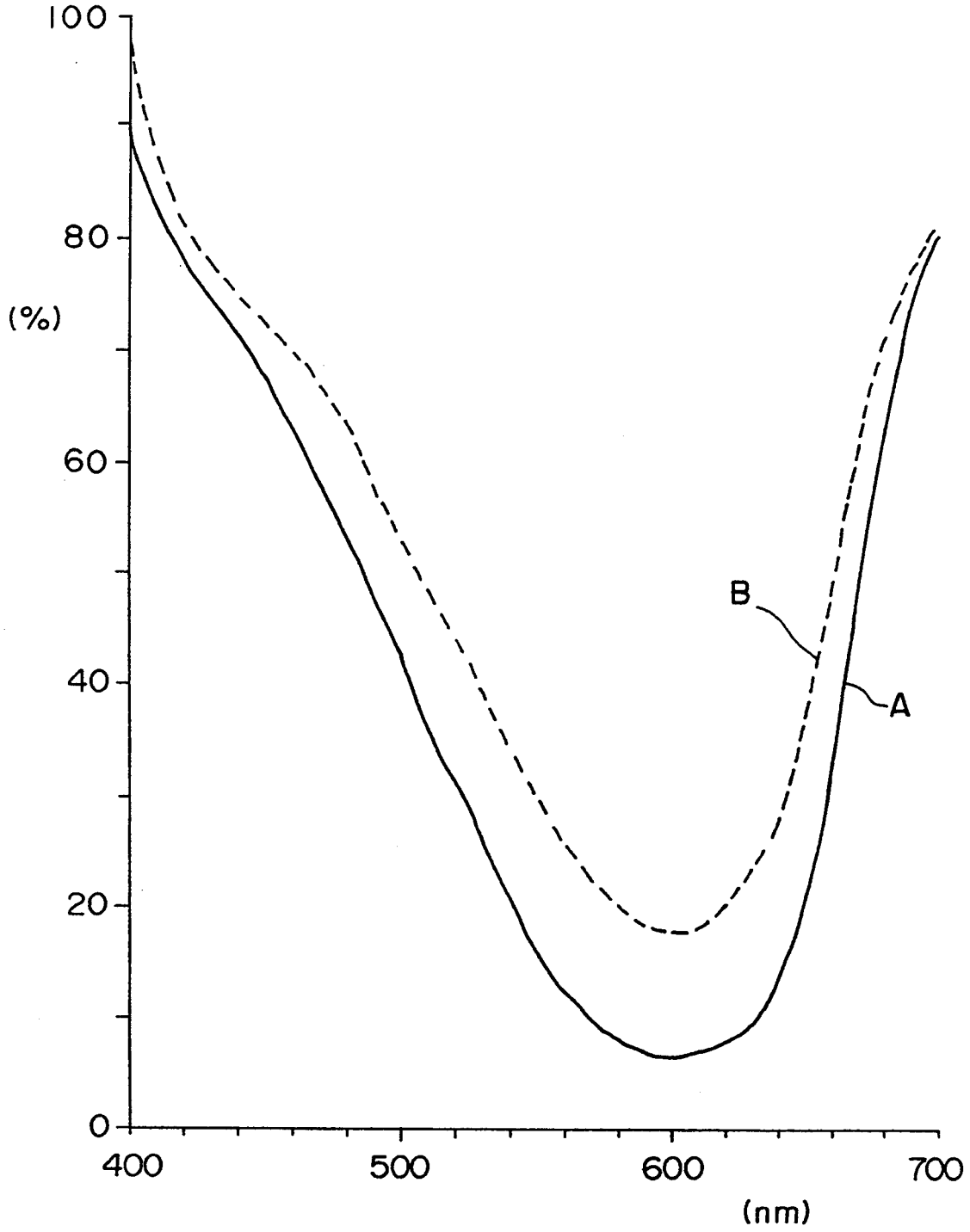
Figure 29:
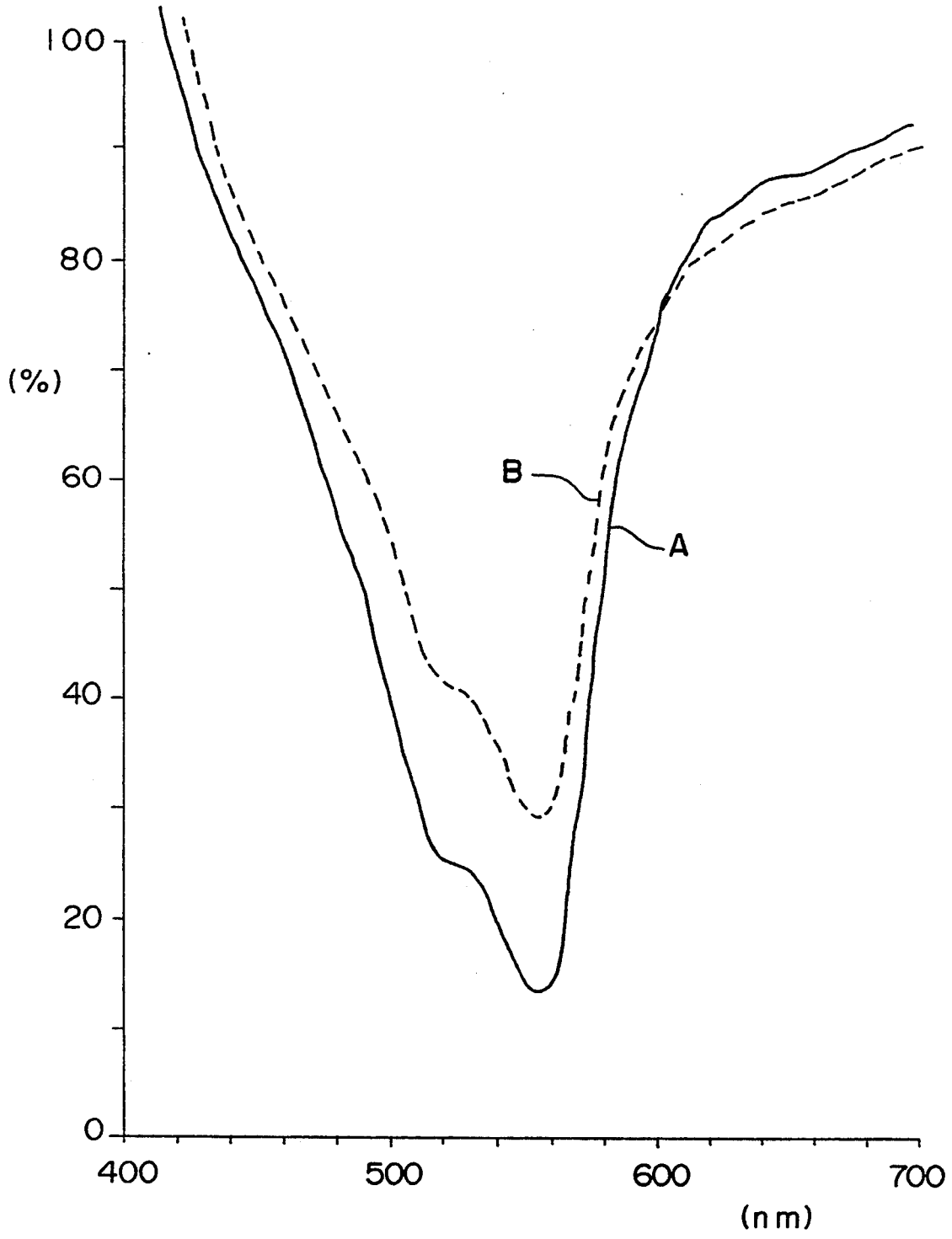

| Color | Spectrum of transmitted light | ΔX (%) | Y (class) |
|---|---|---|---|
| Scarlet | FIG. 23 | 15 | 1 |
| Orange | FIG. 24 | 16 | 1 |
| Green | FIG. 25 | 13 | 2 |
| Cobalt green | FIG. 26 | 19 | 1 |
| Sky blue | FIG. 27 | 11 | 3 |
| Dark blue | FIG. 28 | 12 | 2 |
| Violet | FIG. 29 | 15 | 1 |

As seen from Table 3, the difference in polarized light transmittance ΔX exceeds 10 and the color depth Y is only in the range of class 1 to class 3 in all of the colors.

Example 41

Using the mix spun polyesher filament yarn (34 filaments with 90 defiler in total) as weft, and a hard twist yarn as a warp which was prepared by twisting an ordinary drawn polyester filament yarn (72 filaments with 75 denier in total) at 2,000 twists per meter, a gray fabric was made. The gray fabric was scoured and dyed under the same conditions as those employed in Comparative Example 1 except that, when scoured and set, the fabric was overfed in its warp direction so as to permit the maximum shrinkage to occur, but only a minor shrinkage was permitted to occur in the weft direction. The resultant dyed fabric exhibited a crimp percentage of 26% in the warp direction and a crimp percentage of 3% in the weft direction, namely, was corrugated only in the warp direction.

Although an ordinary polyester filament yarn was used as the weft, only the warp was predominantly exposed on the surface, and therefore, the fabric exhibited a color depth Y value of class 8. The difference in polarized light transmittance ΔX as measured on dyed fibers collected from the surface layer portion of the dyed warp was only 3%, and that as measured on dyed fibers collected from the surface portion of the weft which was not exposed was 35%.

Example 5

Using the mix spun polyester filament yarn (34 filaments with 90 denier in total) as weft, and a heat-resistant acetate filament yarn (20 filaments with 70 denier in total), a gray fabric was made. The gray fabric was scoured and dyed under the same conditions as those employed in Example 4 wherein the fabric was overfed in its warp direction so as to permit the maximum shrinkage to occur, but only a minor shrinkage was permitted to occur in the weft direction. The resultant dyed fabric exhibited a crimp percentage of 22% in the warp direction and a crimp percentage of 5% in the weft direction. The fabric exhibited a color depth Y value of class 9.

Example 6

Polyethylene terephthalate was melt spun at a spinning speed of 2,900 m/min to prepare a filament yarn composed of 144 ultra-fine filaments with 72 denier in total (i.e., single filament=0.4 denier). The filament yarn was heat-treated at a high temperature of 235° C. under relaxed conditions such that the overfeed ratio was 10%, without drawing to prepare a filament yarn characterized in that the non-crystalline portion is oriented only to a negligible extent.

A gray fabric was woven from the filament yarn as both a warp and a weft. The fabric was scoured and dyed under the same conditions as those employed in Comparative Example 1, and was then subjected to a buffing treatment.

Although the fabric is composed of ultra-fine filaments, the fabric exhibited a color depth Y of class 8. It would be noted that ultra-fine filaments exhibit a large irregular reflection and thus their colors are neither bright nor deep, but are tinged with somewhat light brownish color. Therefore, the fabric of this example is distinguished from conventional fabrics composed of ultra-fine filaments which are popularly called as new synthetic fibers.

Example 7

A cationic dye-dyeable polyethylene terephthalate was melt spun into a filament yarn composed of 12 filaments with 30 denier in total wherein the melt-spinning was carried out at an ultra-high draft ratio, i.e., a draft ratio of 200,000 times by using a spinneret with orifices having a very large diameter, which offers a striking contrast with the conventional melt spinning employing a draft ratio of about 100 or so. Thus, the filament yarn characterized as exhibiting an orientation only to a minor extent was obtained directly from a polyester having no orientation.

The filament yarn was knitted into a tricot fabric by using a 36 gauge tricot machine without drawing the filament yarn. The fabric was scoured, dyed with 5% owf of C.I.Disperse Red 92 at 120° C., and then set at 160° C.

Figure 30:
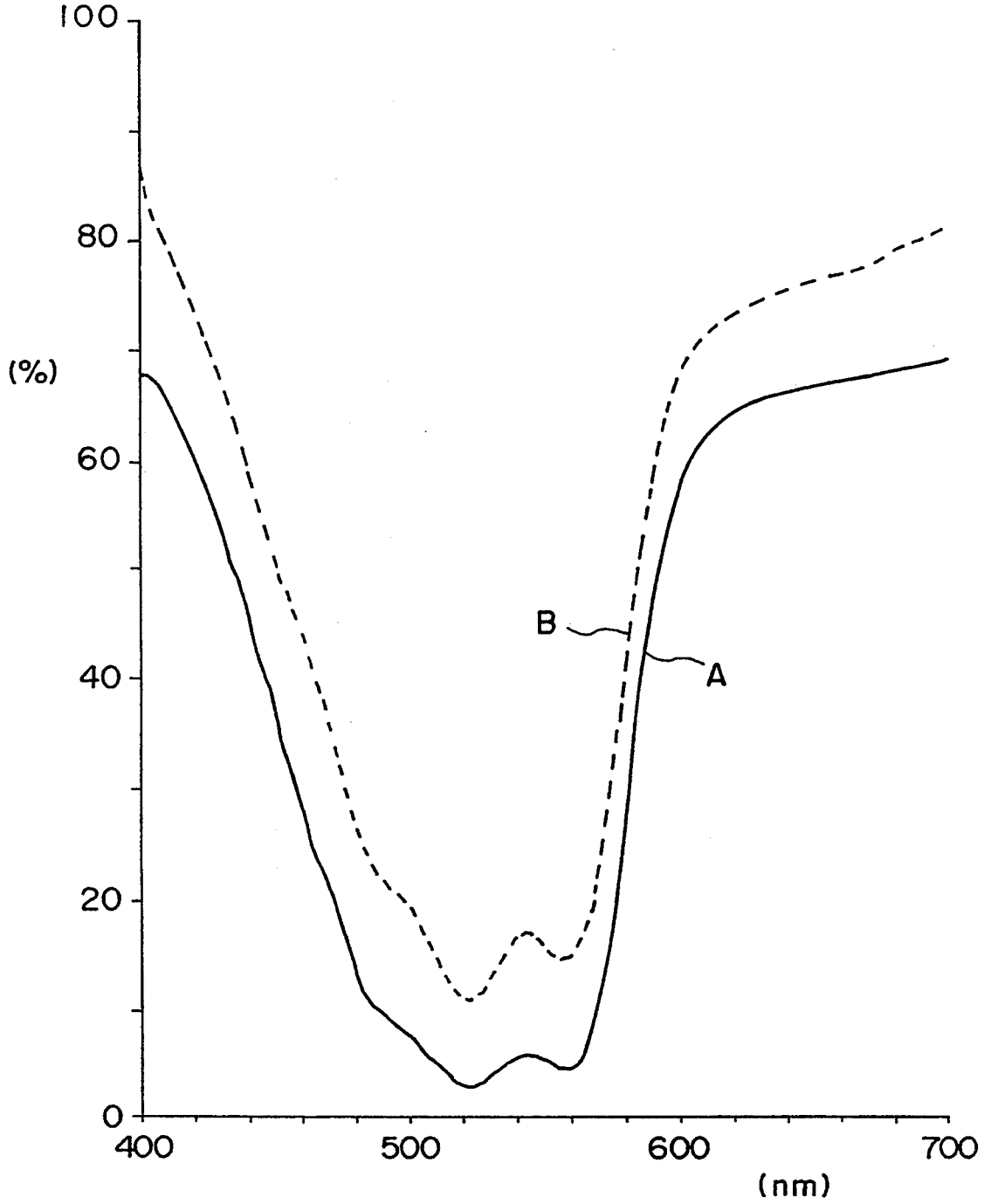

Light transmittances X⊥ and XΠ were determined on dyed fibers collected from the surface layer portion of the dyed fabric. The spectrum of transmitted light in the direction parallel to the fiber axis and that in the direction perpendicular to the fiber axis in the visible light wavelength region are shown as A and B, respectively, in FIG. 30. The difference in polarized light transmittance ΔX was only 8%. The tricot fabric exhibited a color depth y of class 7, which is similar to that of silk.

Example 8

A weft knitted fabric was made by feeding two of the mix spun polyester filament yarn to a 16 gauge interlock tubular knitting machine. The weft knitted fabric was scoured and dyed under the same conditions as employed in Comparative Example 1. The color was brilliant and deep and the color depth Y was class 9.

As a modification of the weft knitted fabric, a weft knitted fabric was made in a similar manner wherein a warp composed of an ordinary polyester filament yarn (24 filaments with 50 denier in total) was inserted into the weft knitting system. The ordinary polyester filament yarn was embedded as a core in the weft knitted fabric, and thus, only the weft was exposed on the surface of the fabric. Therefore, a dyed product of the modified weft knitted fabric had a similarly brilliant and deep color.

Industrial Applicability

The dyed polyester fabric of the invention is superior in feeling and color shade to natural fiber fabrics.

It is to be noted that a polyester conjugate fiber yarn composed of filaments having greatly different shrinkages, which are popularly called as new synthetic fibers, offers a fabric having bulkiness, drapability and touch which are superior to those of silk, but the dyed fabric does not meet the consumers' demand in the color depth. This problem can be solved by the dyed fabric of the invention, which has brilliant and deep color.

The dyed fabric of the invention is useful as scarves, dresses, blouses, jackets, skirts, pants, coats, blouson, curtains and pet covers.

We claim:

1. A deeply dyed polyester fabric composed of warps and wefts, which are dyed with a lightness index L* value of 25 to 65; fibers at least in the surface layer portion of either or both of the warps and the wefts exhibiting a light transmittance that the difference (ΔX in %) between the light transmittance (X⊥ in %) of polarized light vibrating perpendicular to the fiber axis at a wavelength of the maximum absorption and the light transmittance (XΠ in %) of polarized light vibrating parallel to the fiber axis at the same wavelength is not larger than 10%.

2. A deeply dyed polyester fabric according to claim 1, wherein either or both of the warps and the wefts having the fibers satisfying said transmittance requirements at least in the surface layer portion thereof is composed of core fibers and surface layer fibers; and the surface layer fibers have a length at least 5% longer than the core fibers.

3. A deeply dyed polyester fabric according to claim 2, wherein the core fibers have an elongation which is not larger than 40% and not larger than $\frac{2}{3}$ of the elongation of the surface layer fibers; and the core fibers have a strength per denier at least 1.5 times the strength per denier of the surface layer fibers.

4. A deeply dyed polyester fabric according to any of claims 1 to 3, wherein the warps have the fibers satisfying said transmittance requirements at least in the surface layer portion thereof, and the wefts are composed of polyester fibers or other fibers, which are different from the surface layer fibers of the warps; and the warps in the fabric are woven at a crimp percentage larger than that of the wefts in time fabric.

5. A deeply dyed polyester fabric according to claim 4, wherein the wefts are a lard twist yarn having at least 1,000 twists per meter.

6. A deeply dyed polyester fabric according to claim 4, wherein the warps are contained in an amount of at least 55% by weight based on the weight of the fabric.

7. A deeply dyed polyester fabric according to claim 4, which is a mixed woven fabric wherein the wefts are composed of a cellulosic fiber.

8. A deeply dyed polyester fabric according to claim 1 to 3, wherein either of both of the warps and wefts having the fibers satisfying said transmittance requirements at least in the surface layer portion thereof are composed of ultra-fine fibers having a thickness not larger than 1 denier.

9. A deeply dyed polyester fabric according claims 1 to 3, which is dyed with a dyestuff having a molecular weight of at least 380.

* * * * *